US005838757A

United States Patent [19]

Vartanian

[11] Patent Number: 5,838,757

[45] Date of Patent: Nov. 17, 1998

[54] HARD X-RAY POLYCAPILLARY TELESCOPE

[75] Inventor: Michael H. Vartanian, Niskayuna, N.Y.

[73] Assignee: Michael H. Vartanian & Co., Inc., Niskayuna, N.Y.

[21] Appl. No.: 733,487

[22] Filed: Oct. 18, 1996

Related U.S. Application Data

[60] Provisional application No. 60/005,746 Oct. 20, 1995.

[51] Int. Cl.[6] ..... G21K 7/00

[52] U.S. Cl. ..... 378/43; 378/85

[58] Field of Search ..... 378/43, 84, 85, 378/145; 250/505.1

[56] References Cited

U.S. PATENT DOCUMENTS

| | | | |
|---|---|---|---|
| 4,562,583 | 12/1985 | Hoover et al. | 378/85 X |
| 4,941,163 | 7/1990 | Hoover | 378/43 |
| 5,016,265 | 5/1991 | Hoover | 378/43 |
| 5,146,482 | 9/1992 | Hoover | 378/43 |
| 5,192,869 | 3/1993 | Kumakhov | 250/505.1 |
| 5,432,349 | 7/1995 | Wood et al. | 378/43 X |
| 5,570,408 | 10/1996 | Gibson | 378/84 X |
| 5,604,353 | 2/1997 | Gibson et al. | 250/505.1 |

OTHER PUBLICATIONS

Allan W. Snyder and John D. Love, Institute of Advanced Studies Australian National University Canberra, Australia, "Optical Waveguide Theory" no date.

A 15–Year Plan for X–Ray Astronomy; 1993–2008, Report of the X–Ray Astronomy Program Working Group, NASA, Sep. 1993.

G. Nakano, J. Kilner, M. Murphy, M. Vartanian, ANGAS: a New Spaceborne High Resolution Gamma–ray Spectrometer, in Nuclear Spectroscopy of Astrophysical Sources, ed. N. Gehrels, AIP vol. 170, pp. 432–438, 1988.

J. H. Ahlberg, E.N. Nilson and J.L. Walsh, The Theory of Splines and Their Applications, Academic Press, 1967.

Working Papers—Astronomy and Astrophysics Panel Reports "High Energy from Space", Astronomy and Astrophysics Survey (Bahcsll) Committee, National Research Council, pp. VI1–VI23, 1991.

Walter M. Gibson and Carolyn A. MacDonald, Polycapillary Kumakhov Optics: A Status Report. SPIE vol. 2278, pp. 156–167 (1994).

M.A. Kumakhov, State and Perspectives of Capillary Roentgen Optics, SPIE vol. 2011, pp. 193–203, 1994.

M. Vartanian, R. Youngman, D. Gibson, J. Drumheller, R. Frankel, Polycapillary Collimator for Point Source Proximity X–ray Lithography, J. Vac. Sci. Technol. B, vol. 11(6), pp. 3003–3007, Nov./Dec., 1993.

(List continued on next page.)

*Primary Examiner*—David P. Porta

*Attorney, Agent, or Firm*—Jordan and Hamburg

[57] ABSTRACT

An x-ray telescope has a tubular housing subdivided into M number of radial segments each having a detector for detecting x-rays and an optic module for focussing x-rays onto the detector. The optic modules have polycapillary fibers assembled in subunit layers and asymmetrically arranged about an optical axis. The polycapillary fibers follow a natural cubic spline path to maximize transmission. The polycapillary fibers selectably collimated and decollimated to provide a predetermined field-of-view. A Fourier grid assembly is disposed in front of the optic modules and has M pairs of entrance and exit grids each aligned with a respective one of the optic modules. The pairs of entrance and exit grids have spaced apart bars with a bar spacing period such that N number of the bar spacing periods at the entrance grid subtends the predetermined field-of-view of the polycapillary fibers where N is an integer and is different for each of the pairs of entrance and exit grids. The pairs of grids are phased apart by ⅛ of the bar spacing period. The Fourier grid assembly is rotatably mount to provide incremental alignment with the optic modules thus permitting simultaneous measurement of polarimetry and imaging data.

27 Claims, 20 Drawing Sheets

OTHER PUBLICATIONS

W.M. Gibson and M.A. Kumakhov, Applications of X–ray and Neutron Capillary Optics, in X–Ray Detector Physics and Applications, SPIE vol. 1736, pp. 172–189, 1992.

P. Gorenstein, Modelling of Capillary Optics as a Focussing Hard X–ray Concentrator, Multilayer and Grazing Incidence X–Ray/EUV Optics, SPIE vol. 1546, pp. 91–99, (1991).

L.N. Mertz, G.H. Nakano, J.R. Kilner, Rotational Aperture Synthesis for X–rays, J. Opt. Soc. Am. A3, pp. 2167–2170, 1986.

M.A. Kumakhov and F.F. Komarov, Multiple Reflection from Surface X–ray Optics, pp. 291–350, 1990 Phys. Report vol. 191.

HARD X-RAY POLYCAPILLARY TELESCOPE

REFERENCE TO RELATED APPLICATIONS

This application claims the benefit of U.S. provisional application serial no. 60/005,746 having a filing date of Oct. 20, 1995 and entitled HARD X-RAY POLYCAPILLARY TELESCOPE.

BACKGROUND OF THE INVENTION

The present invention relates to an x-ray telescope and, more particularly, to a hard x-ray telescope having polycapillary fiber optics controllable to permit variation of a field-of-view allowing operation in both a wide field imaging mode and a narrow field high sensitivity non-imaging mode. Imaging is accomplished using Fourier aperture synthesis methods, and more particularly those employing the Hartley transform. The telescope is designed to permit operation from balloon or rocket carried platforms.

Polycapillary fiber optics were introduced in the mid-1980's and function as fiber optics for x-rays. M. A. Kumakhov and F. F. Komarov, Multiple Reflection from Surface X-ray Optics, Phys. Reports, Vol. 191, pp. 290–350, 1990. As is known, in traditional fiber optics, a solid glass fiber has a core with a higher index of refraction than a cladding surrounding the core permitting visible-light to be continuously internally reflected as the light travels through the fiber. Since the refractive index of glass is less than unity at x-ray wavelengths, in a polycapillary fiber empty space substitutes for the higher refractive index glass core of visible-light fibers. Outward dimensions of the polycapillary fibers are similar to those of conventional optical fibers, however, since the index is only slightly less than unity, each fiber actually comprises thousands of small, parallel channels in order to allow practical bending geometries and throughput. The individual fibers are then arrayed in bundles of several thousands to form bulk optics with apertures many centimeters in diameter.

Thermal processes often dominate the emission from x-ray emitting objects at soft and medium energies. However, these thermal processes cut off at higher energy levels. The absence of thermal processes at the higher energy levels presents the possibility of exposing underlying non-thermal radiation expected from relativistic plasmas, intense magnetic fields, accretion disks, and other matter in extreme states. Unfortunately, fluxes at hard energies, from even brighter sources, are at best commensurate with residual detector backgrounds in the absence of flux concentration techniques and conventional double-reflection grazing incidence flux concentration techniques become difficult or impractical above ≈10 keV.

Because the hard x-ray band is a potentially fertile, but still largely unexplored, region of the spectrum for astronomical studies, the need to develop hard x-ray instrumentation has often been expressed in the past. The Decade of Discovery in Astronomy and Astrophysics, Astronomy and Astrophysics Survey (Bahcall) Committee, National Research Council, 1991; A 15-Year Plan for X-Ray Astronomy. 1993–2008, Report of the X-Ray Astronomy Program Working Group, NASA, September 1993. Increased sensitivity at these energies has therefore required large area detectors on sizable space platforms (e.g. HEXTE).

The potential of polycapillary optics as flux concentrators for x-ray astronomy has been recognized. Multiple Reflection from Surface X-ray Optics, supra. However, following effective area calculations with estimates of flux concentration for hypothetical arrays of polycapillary concentrators sized for satellite or balloon payloads, it was concluded that although such optics coupled to solid-state spectrometers could provide unprecedented spectral sensitivity up to 100 keV, their narrow field-of-view at high energies limited their use to studies of isolated point sources. P. Gorenstein, Modelling of Capillary Optics as a Focussing Hard X-ray Concentrator, Multilayer and Grazing Incidence X-Ray/EUV Optics, SPIE Vol. 1546, pp. 91–99, (1991).

Such a limitation would require prior knowledge of source locations and alignment and pointing accuracies to an arcminute or better.

Classical methods for telescope design make use of refractive lens and reflective mirrors but such techniques do not work for x-rays. It is possible in principle however to form x-ray images of the sky in an indirect manner. The idea is to measure the x-rays transmitted through certain special sets of opaque, patterned masks, and then to mathematically recombine these signals, using a digital computer, to form the image. One such method is the Fourier aperture synthesis technique proposed by L. Mertz, discussed further below.

There have been few implementations of indirect x-ray imaging techniques to date and those suffer from the basic drawback that the x-ray detector must be made as large as the mask. By contrast, conventional telescopes focus the image onto small areas. Using a large x-ray detector is undesirable because detector noise increases with its size. As a result, the signal-to-noise ratio, or sensitivity, of such telescopes is insufficient for practical application.

SUMMARY OF THE INVENTION

Accordingly, it is an object of the invention to provide a hard x-ray telescope which overcomes the drawbacks of the prior art.

It is a further object of the invention to provide a hard x-ray telescope having a field-of-view sufficient for use with Fourier grids to provide imaging capability useful for surveys, avoidance of confusion, precise determination of source locations, and mapping extended regions, thus reducing requirements on pointing, while maintaining high sensitivity.

It is a still further object of the invention to provide a hard x-ray telescope which can provide fail-safe yet cost effective operation to overcome initial uncertainties regarding in-flight performance.

It is yet another object of the invention to provide a hard x-ray telescope which is modular in construction to permit upgrades for enhancing future astronomical studies.

An object of the present invention is to provide a polycapillary fiber optic module for focusing x-rays with minimal losses wherein polycapillary fibers have a natural cubic spline configuration.

Another object of the present invention is to provide a polycapillary fiber optic module for focusing x-rays with minimal losses wherein polycapillary fibers are selectively collimated and decollimated.

Additionally, an object of the present invention is to provide an x-ray telescope for obtaining polarimetry data by using a polycapillary fiber optic module with an asymetric distribution of said polycapillary fibers about an optical axis of the module.

Yet another object of the present invention is to provide an efficient method for the assembly of polycapillary optics.

Furthermore, the present invention provides a method for x-ray imaging using the Hartley transform allowing the use of only one Fourier grid pair for each spatial frequency.

Still another object of the present invention is to provide an x-ray telescope capable of simultaneously gathering both imaging and polarimetry data.

Briefly stated, the present invention provides an x-ray telescope having a tubular housing subdivided into M number of radial segments each having a detector for detecting x-rays and an optic module for focussing x-rays onto the detector. The optic modules have polycapillary fibers assembled in subunit layers and asymetrically arranged about an optical axis. The polycapillary fibers follow a natural cubic spline path to maximize transmission. The polycapillary fibers selectably collimated and decollimated to provide a predetermined field-of-view. A Fourier grid assembly is disposed in front of the optic modules and has M pairs of entrance and exit grids each aligned with a respective one of the optic modules. The pairs of entrance and exit grids have spaced apart bars with a bar spacing period such that N number of the bar spacing periods at the entrance grid subtends the predetermined field-of-view of the polycapillary fibers where N is an integer and is different for each of the pairs of entrance and exit grids. The pairs of grids are phased apart by ⅛ of the bar spacing period. The Fourier grid assembly is rotatably mount to provide incremental alignment with the optic modules thus permitting simultaneous measurement of polarimetry and imaging data.

In accordance with these and other objects of the invention, there is provided an x-ray apparatus for use in imaging an object, comprising: detectors for detecting x-rays; optic modules, each of the optic modules being disposed in front of a respective one of the detectors and having an optical axis aligned therewith, each of the optic modules having polycapillary fibers with entrance ends open to an entrance aperture of the x-ray telescope and exit ends aligned to direct x-rays entering the entrance ends to the respective one of the detectors, the polycapillary fibers being decollimated at the entrance ends to provide a predetermined field-of-view; a Fourier grid assembly disposed in front of the optic modules and having pairs of entrance and exit grids each aligned with a respective one of the optic modules, the pairs of entrance and exit grids having spaced apart bars with a bar spacing period such that an integral number of bar spacing periods at the entrance grid subtends the predetermined field-of-view of the polycapillary fibers, the entrance and exit grid pairs having more than one integral number of bar spacing periods; and means for rotating as a whole the optic modules, the detectors and the Fourier grid assembly with respect to the object to acquire imaging data from the detectors.

The present invention also provides a method of constructing an optic unit from polycapillary fibers comprising: disposing a first layer of the polycapillary fibers in a mould tray having a flat bottom and a curve defining inner side surface configured in accordance with a natural cubic spline where an outermost one of the polycapillary fibers is laid on the flat bottom and lengthwise abutting the curve defining inner side surface and remaining ones of the polycapillary fibers of the first layer are laid lengthwise abutting one another and the outermost polycapillary fibers to form a single layer whereby each of the polycapillary fibers is bent in a plane of the first layer to conform to the natural cubic spline; fixing together the first layer of the polycapillary fibers using an adhesive agent; disposing and fixing together a predetermined number of subsequent layers atop the first and preceding layers to form a subunit; disposing and fixing the subunits radially about an optical axis of the optic unit such that the polycapillary fibers have exit ends thereof focused on a common focal point.

According to a feature of the invention, there is further provided the x-ray telescope wherein the optic modules have the polycapillary fibers asymmetrically arranged with respect to the optical axes thereof to permit detection of polarimetry data; and the apparatus further includes means for rotating the Fourier grid assembly with respect to the optic modules to successively align respective ones of the entrance and exit grid pairs with respective ones of the optic modules to acquire both the polarimetry data and the imaging data from the detectors by independently modulating the imaging data and the polarimetry data to permit separation thereof. The present invention further includes the entrance and exit grids being phased apart by ⅛ of the bar spacing period; calculating means for applying Hartley transform techniques to the imaging data to produce an image of the object; and means for transmitting the imaging data to the calculating means.

The invention further provides an optic module for focusing x-rays onto a focal point, comprising: polycapillary fibers arranged in subunit layers radially disposed about an optical axis of the optic module, in line with the focal point, the subunit layers having an inside edge closest to the optical axis and an outside edge furthest from the optical axis; the polycapillary fibers of each of the subunit layers being configured along a path of a natural cubic spline, having entrance ends disposed at an entrance plane of the optic module, and having varying lengths as determined by exit ends disposed at tangential points on the polycapillary fibers whereat a straight line from the focal point tangentially intersects the natural cubic spline; the subunit layers including a plurality of single layers of the polycapillary fibers stacked upon one another; and means for fixing the subunit layers about the optical axis.

An embodiment of the present invention further provides an x-ray telescope for imaging an object comprising: a tubular housing subdivided into M number of radial segments, each of the radial segments having a detector for detecting x-rays disposed proximate a base end of the tubular housing and an optic module at an entrance aperture of the tubular housing for focussing x-rays entering the entrance end onto the detector; each of the optic modules having polycapillary fibers with entrance ends open to the entrance aperture and exit ends aligned to direct x-rays entering the entrance ends to an associated one of the detectors, the polycapillary fibers being decollimated at the entrance ends to provide a predetermined field-of-view; a Fourier grid assembly disposed in front of the optic modules and having M pairs of entrance and exit grids each aligned with a respective one of the optic modules, the pairs of entrance and exit grids having spaced apart bars with a bar spacing period such that N number of the bar spacing periods at the entrance grid subtends the predetermined field-of-view of the polycapillary fibers where N is an integer and is different for each of the pairs of entrance and exit grids; and each of the pairs of grids having the entrance grid and the exit grids phased apart by ⅛ of the bar spacing period for the pair of grids; and means for rotating as a whole the tubular housing and the Fourier grid assembly with respect to the object to acquire imaging data from the detectors.

In particular, the present invention provides an x-ray telescope with x-ray imaging capability. As described below, this capability is provided an energy-independent 15 arc-minute FWHM field-of-view by using decollimation meshes at an entrance aperture to perinit use of a Fourier synthesis aperture, and providing a means for rotating the telescope. A key feature, which takes advantage of the fibers' flexibility, is that the field-of-view is controllable in flight using at least one actuated meshes. A possible application scenario is to launch the x-ray telescope above the atmosphere and to first locate faint targets in the imaging mode using coarse energy bins and later in the flight to concentrate the total effective area on individual target pointings. This illustrates some advantages of polycapillaries optics in practice: not only does their ability to concentrate radiation onto small detectors eliminate the need for the heavy shielding typical of hard x-ray experiments, but at the same time the low background makes flux-limited observations up to high energies possible for brighter sources even for short times available on rocket flights.

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
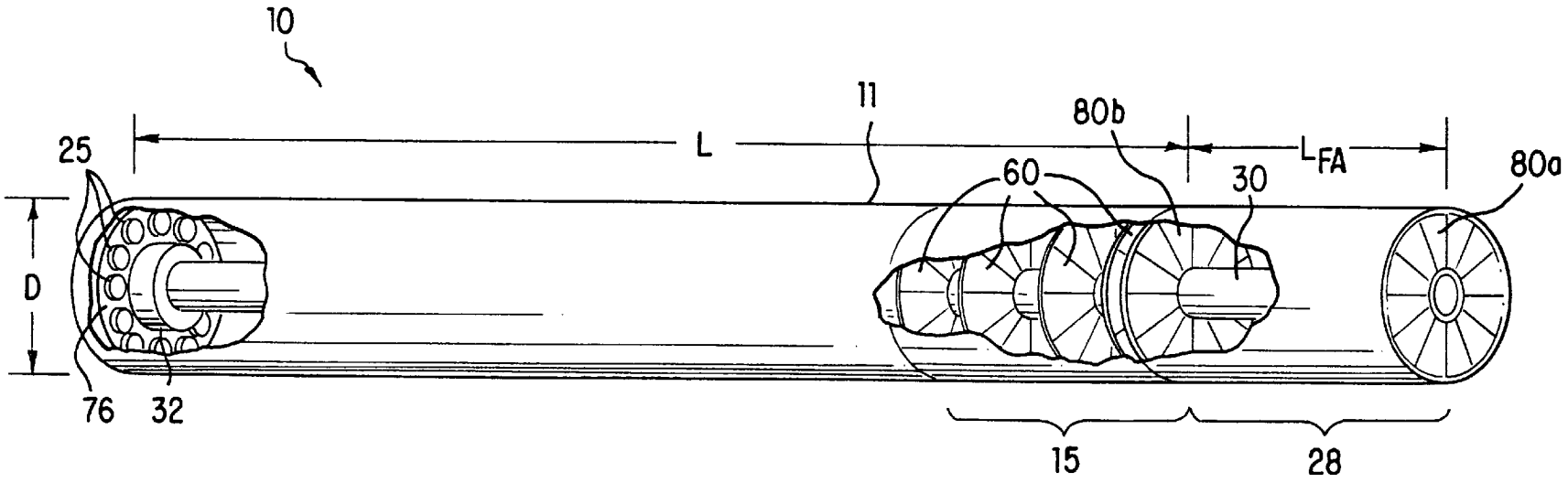
FIG. 1 is a simplified perspective view with cut-away portions showning an embodiment of the present invention omitting polycapillary fibers and vane partitions.
Figure 2:
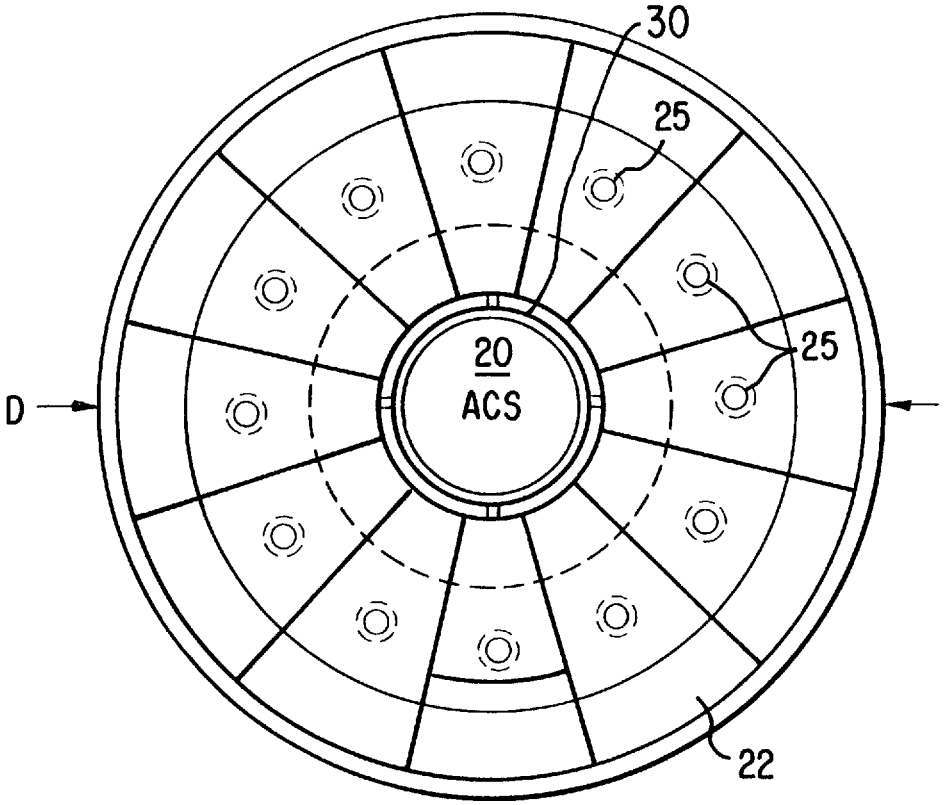
FIG. 2 is a simplified front view of the embodiment of FIG. 1 omitting grids and polycapillary fibers.

Referring to FIGS. 1 and 2, there is shown in simplified form an embodiment of a polycapillary x-ray telescope 10 having a non-imaging length L of 330 cm and a diameter D of 56 cm. The tubular shell 11 is formed from any material of suitable strength to weight characteristics, such as aluminum for instance. An optics assembly 15 fills an annular portion of the x-ray telescope 10 surrounding attitude control and fiducial systems (ACS) 20 housed in a center core of the x-ray telescope 10. The optics assembly 15 is partitioned into twelve optic modules 22 each including polycapillary fibers (not shown for clarity purposes) supported by meshes 60. Each of the optic modules 22 focuses on a respective one of twelve detectors 25. The use of the twelve optic modules 22 roughly optimizes a tradeoff between high energy response and imaging resolution—which improve with an increasing number of modules—and broadband sensitivity and complexity—which worsen as the number of modules increases. A focal length of 284 cm, as measured from the front of the optics assembly 15 to a plane of the detectors 25, is provided for within the overall envelope.

In front of the optic modules 22 is a Fourier rotating aperture grid assembly 28 mounted on a rotating core shaft 30. The core shaft 30 is driven by a motor 32 housed in the base of the x-ray telescope 10 proximate the plane of the detectors 25. The grid assembly 28 has entrance and exit grids, 80*a* and 80*b*, each partitioned into twelve sections having gratings (not shown) of differing dimensions. In the embodiment presently described the length $L_{FA}$ is 80 cm.

The overall geometry of the embodiment of the x-ray telescope 10 (without Fourier rotating aperture grid assembly 28) is designed to fit within a standard NASA (National Aeronautics and Space Administration) research rocket. Adaptation of such rockets or the use of alternative platforms permits incorporation of the Fourier rotating aperture grid assembly 28 for imaging purposes discussed below. Such adaptations are realizable by those skilled in the art and hence are not addressed herein. It is understood that alteration of the dimensions presented herein may be effected by those of ordinary skill in the art of x-ray optics having the benefit of the present disclosure and that the dimensions presented are exemplary of the embodiment shown and not limiting. Dependent upon the selected deployment platform, dimensions may be varied as required to meet various criteria discussed herein.

Figure 3:
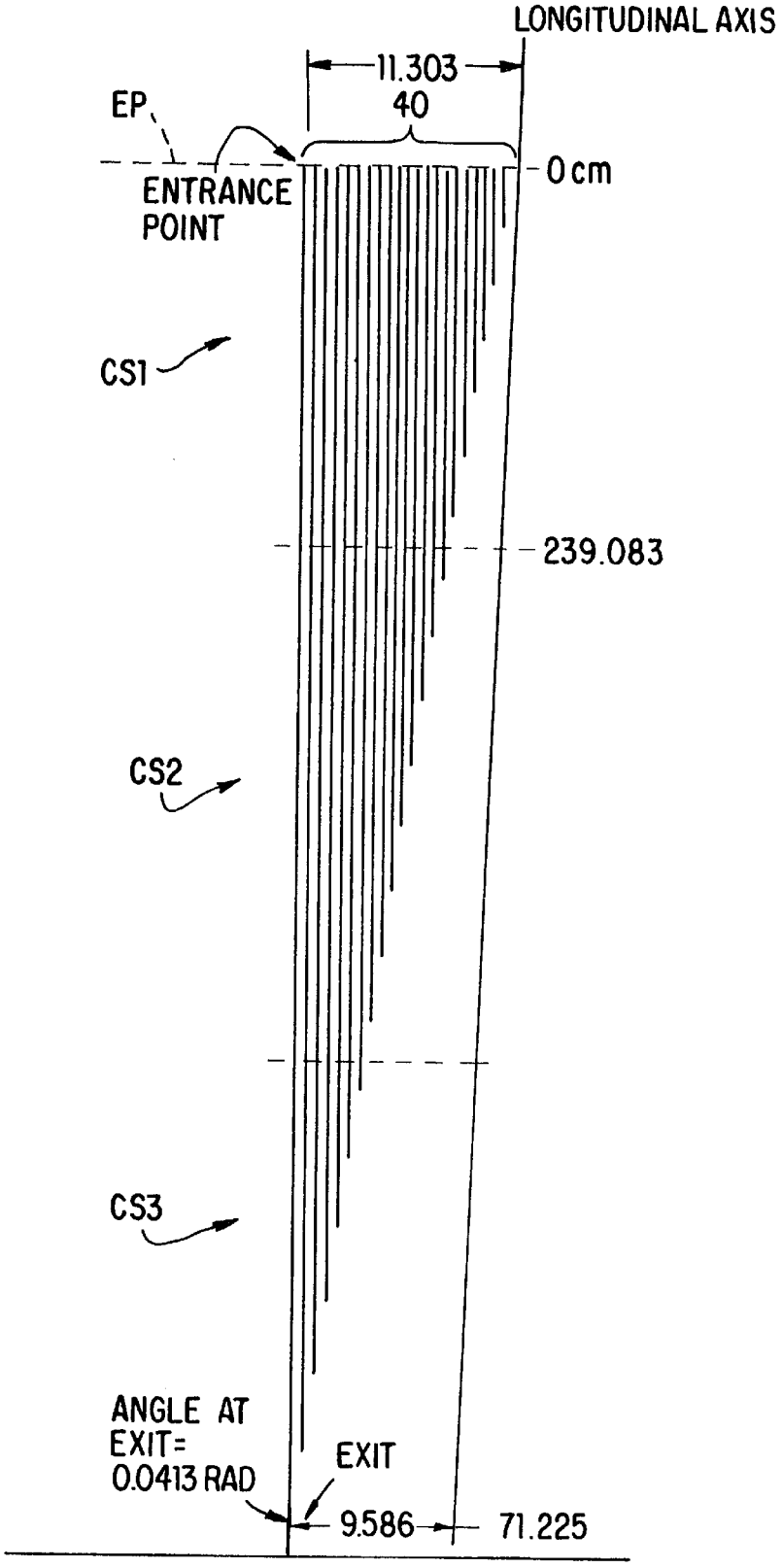
FIG. 3 is a simplified diagram of an arrangement of the polycapillary fibers of the embodiment of FIG. 1.

Referring to FIG. 3, a half planar cross section of one of the optic modules 22, the cross section being taken along the longitudinal axis of the optic module 22, shows an arrangement of polycapillary fibers 40. The polycapillary fibers 40 are shown greatly enlarged and reduced in number for the purpose of clarity in showing the configuration of the polycapillary fibers 40. The polycapillary fibers 40 are disposed symmetrically as practical about the longitudinal axis except as truncated to conform to the area within the subtended angle of the optic module 22 as discussed below. The polycapillary fibers 40 are disposed in conformance with a path of an optimum cubic spline. The advantages of polycapillary fibers have been discussed extensively before in papers such as those by M. A. Kumakhov and F. F. Komarov, Multiple Reflection from Surface X-ray Optics, Phys. Reports, Vol. 191, pp. 290–350, 1990, and by W. M. Gibson and M. A. Kumakhov, Applications of X-ray and Neutron Capillary Optics, in X-Ray Detector Physics and Applications, SPIE Vol. 1736, pp. 172–189, 1992, which are incorporated herein by reference for their teachings relating to analysis of the performance characteristics of polycapillary optics. Heretofore, conventional x-ray optics employed reflector sheets concentrically aligned to redirect x-rays to a focal point using grazing incidence reflection. The Fresnel coefficient for grazing incidence reflection from a plane surface is $$R = 1 - \frac{4\sin\theta\, Re\ (n^2 - \cos^2\theta)^{1/2}}{\left|\sin\theta + \{n^2 - \cos^2\theta\}^{1/2}\right|^2} \quad 0 \leqq \theta \leqq \pi/2$$

where θ is the grazing angle, n the complex refractive index of the glass:

$$n = n^r + in^i \quad n^r \propto E^{-2} \quad n^i = \alpha\lambda/4\pi$$

α the glass bulk attenuation coefficient, and λ the wavelength. The critical angle is $$\theta_{crit} \equiv [1 - (n^r)^2]^{1/2} \simeq \frac{.03}{E(keV)} \text{ radians}$$

Figure 4A:
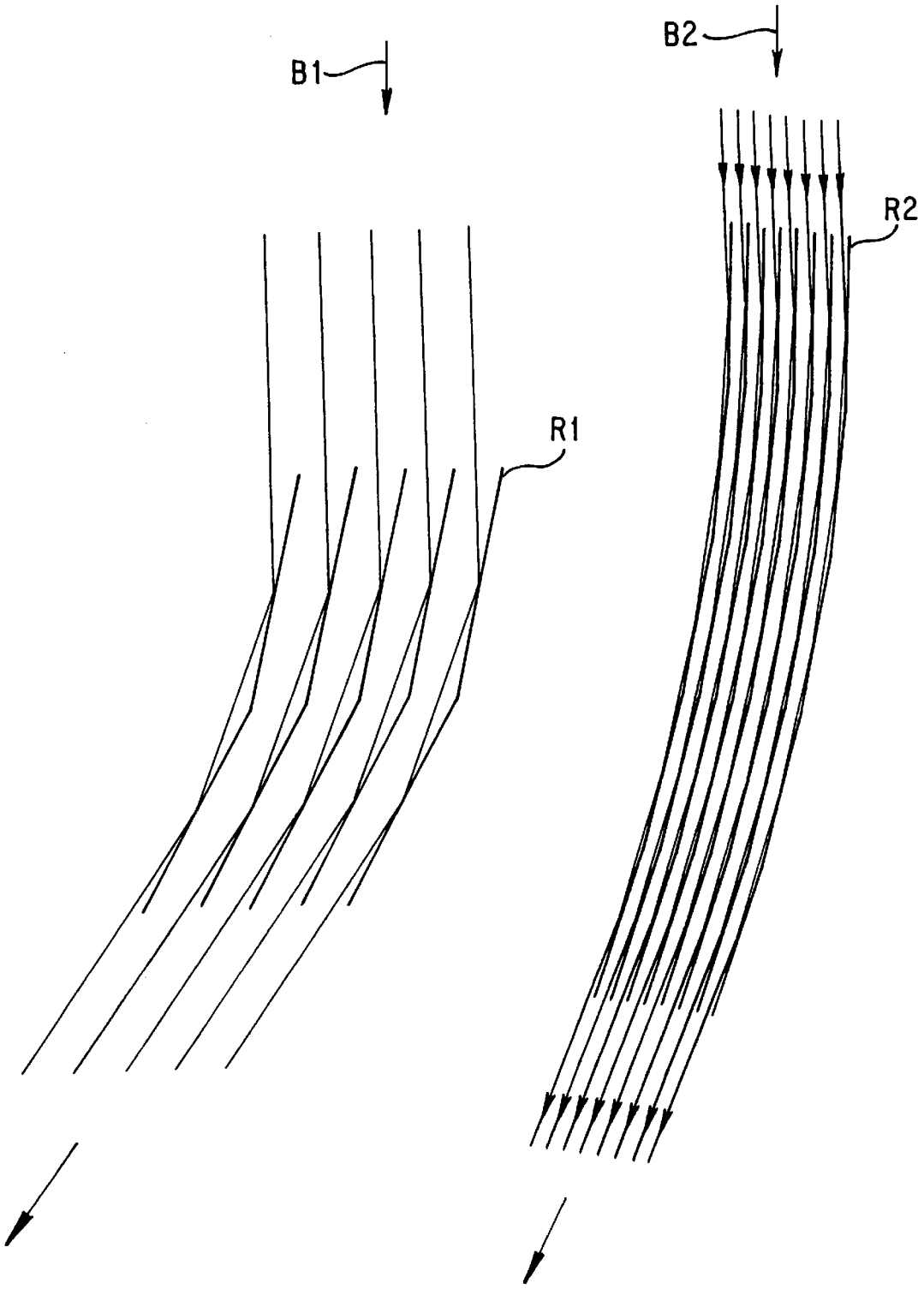
FIG. 4*a* is a graphic representation of x-ray reflection illustrating varying numbers of reflections.

The basic advantage of polycapillary optics is illustrated by the example shown in FIG. 4*a*. Suppose it is required to bend a parallel beam of x-radiation through a given angle. At hard x-ray energies, this is likely to be much larger than the critical angle (e.g. 1 milliradian at 60 keV). Consider a simple grazing incidence optic constructed from a series of n contiguous plane reflecting surfaces. Two cases are shown in FIG. 4*a*: one in which reflector sheets R1 use two reflections to redirect an x-ray beam B1 through the given angle, and another wherein reflector sheets R2 use five reflections to redirect x-ray beam B2. Note that it is necessary to "stop" the beam down into narrow channels for this optic to work as desired, and furthermore, that if the reflective surface were curved as for actual capillaries, the width of the channel alone would determine the number of reflections.

Figure 4B:
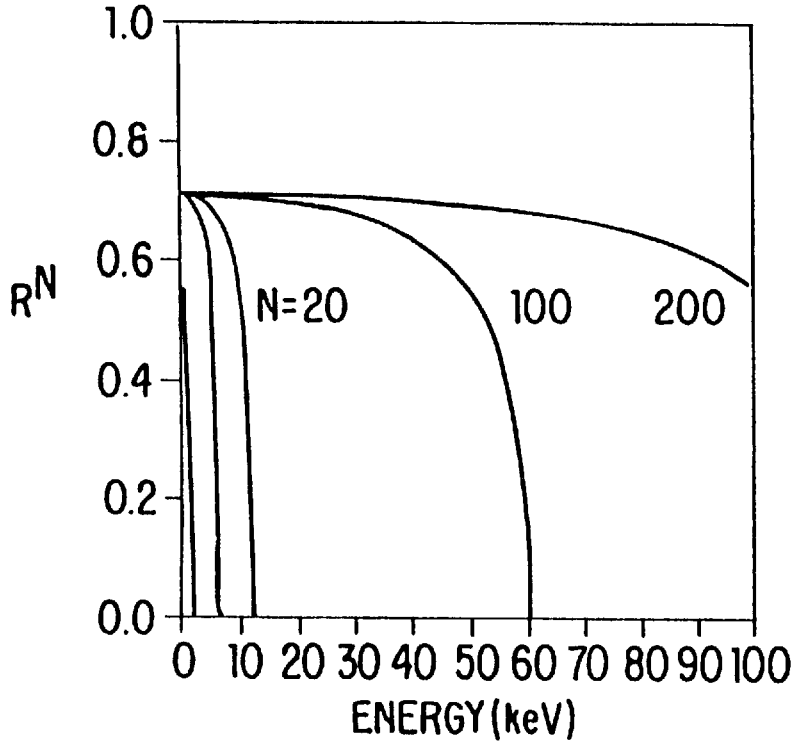
FIG. 4*b* is a graph showing transmission efficiency versus energy level for various numbers of reflections.

Referring to FIG. 4*b*, the total efficiency versus energy for N reflections is shown. It is clear that the energy bandpass is higher the more the number of reflections, at shallower angles, that bend the radiation through the given angle. The polycapillaries fibers 40 function by using a large number of grazing-incidence reflections at small angles from smooth, glass walls to bend radiation efficiently through angles many times larger than critical. This contrasts with conventional grazing incidence optics which employ one or two reflections only. It is also clear that a smaller channel size gives a higher energy bandpass. However, due to limited field of view, practical applications of polycapillary optics have been primarily limited to those such as collimators used in x-ray lithography. M. Vartanian, R. Youngman, D. Gibson, J. Drumheller, R. Frankel, Polycapillary Collimatorfor Point Source Proximity X-ray Lithography, J. Vac. Sci. Technol. B, Vol. 11(6), pp. 3003–3007, Nov/Dec, 1993.

Figure 5:
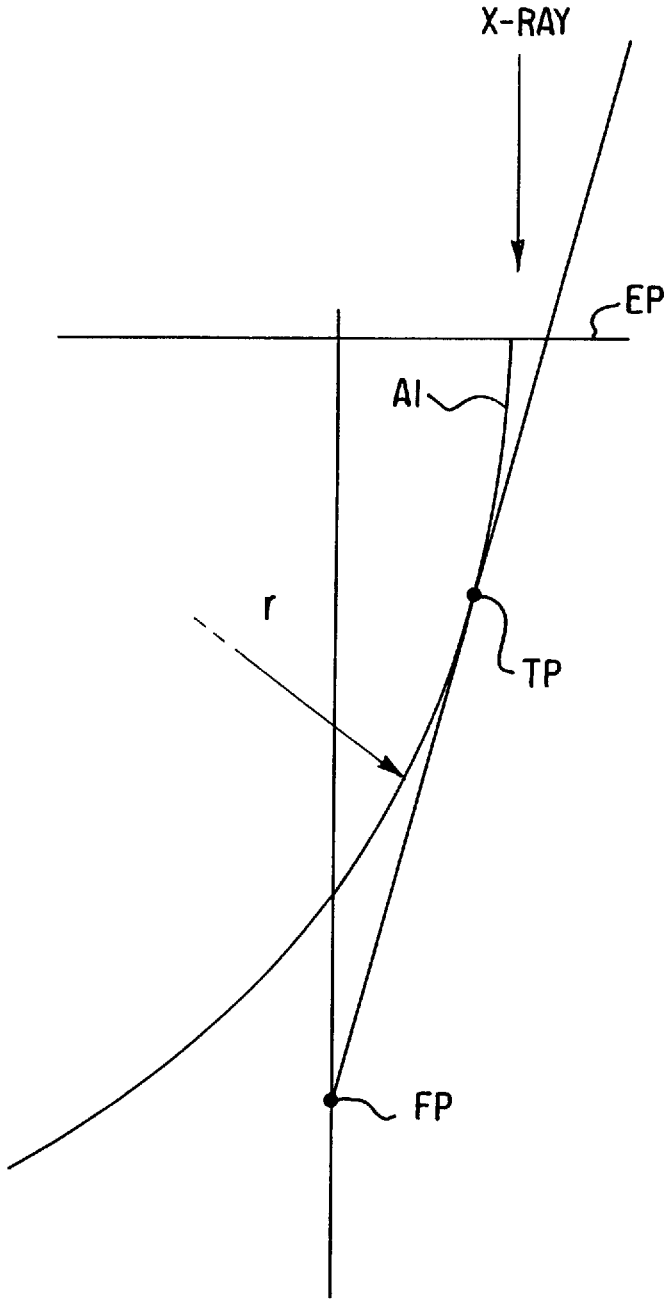
FIG. 5 is a graph showing a garphical depiction of x-ray travel in a polycapillary fiber.

Referring now to FIG. 5, a simplified representation of the curvature of a single polycapillary fiber for focusing an x-ray at a focal point FP is shown. The x-ray enters the polycapillary fiber perpendicular to the entrance plane EP of the entrance aperture. For the purpose of illustration, the path defined is representative of the outermost one of the polycapillary fibers 40 of the optic module 22. For a given radius r, shown exaggerated in size in the figure, an arc A1 is defined. The x-ray enters the path at the entrance aperture and travels to a point TP whereat a straight line intersecting the focal point FP is tangent to the arc A1. Transmission losses occur due to sharp bends, abrupt changes in bend radius, and long fiber length. In order to maximize the x-ray radiation focussed upon the focal point, a universal optimizing curve is sought to minimize transmission losses. The universal optimizing curve turns out to be a cubic spline. Each fiber will then be configured along a section of the universal optimizing curve based upon the above determinations. To determine the optimum cubic spline, the radius r is chosen to maximize the transmission coefficient of the system at the upper energy levels. X-ray transmission analysis is described in the paper Multiple Reflection from Surface X-ray Optics cited above.

The transmission coefficient increases with decreasing curvature, that is, the amount of x-rays transmitted increases, the optimum curvature is that of natural paraxial cubic splines (hereinafter "cubic splines"). Cubic splines exhibit the mathematical minimum curvatureproperty. J. H. Ahlberg, E. N. Nilson and J. L. Walsh, *The Theory of Splines and Their Applications*, Academic Press, 1967. Since an x-ray entering the polycapillary fiber is entering straight, that is parallel to the axis of the optic module 40, a straight entrance path is dictated. However, a circular arc minimizes changes in radius, but cannot be joined with a straight path without an abrupt change in curvature. The function which minimizes losses due to the above geometric characteristics, while channeling guiding x-rays from the entrance of the polycapillary fiber 40 to its exit, is the cubic spline.

The determination of the optimum cubic spline is begun by finding the exit position and direction at point TP along the arc A1 of FIG. 5. The transmission coefficient is determined as the radius r of the arc A1 is varied and the arc that maximizes transmission is selected to determine the exit position and direction where the entrance position and direction are given. The end conditions as determined for the preferred embodiment are given in Table I.

| CONSTRAINT | DIMENSION |
|---|---|
| Entrance Point Axial Coordinate | 0.00 cm |
| Entrance Radial Distance from Axis | 11.303 cm |
| Entrance Direction relative to Axis | 0.00 rad |
| Exit Axial Coordinate | 71.725 cm |
| Exit Radial Distance from Axis | 9.586 cm |
| Exit Direction relative to Axis | 0.04513 rad |
| section Length | 23.9083 cm |
| Focal Point Axial Coordinate | 284.00 cm |

The cubic spline consists of a number of third-degree polynomial sections such that the directions and curvatures of adjacent sections are equal at junctions of the sections. Thus, the fiber path is chosen to be straight at the entrance and to approach uniform curvature through the bend while having the unique property of minimizing changes in curvature throughout. In the present situation, the x coordinate along the longitudinal module axis is the independent variable and the radial distance r to the axis is the dependent variable. To satisfy the above end conditions, or constraints, at least three cubic sections CS1, CS2, and CS3 are optimally used as shown in FIG. 3. It can be shown that the "minimal" three section spline having equal section lengths along the longitudinal axis is also the optimum cubic spline.

Mathematically, each cubic polynomial subsection is represented by the formula:

$$r_i(x)=a_i+b_i x+c_i x^2+d_i x^3 \qquad i=1,2,3$$

The twelve coefficients ( $a_i$,$b_i$, $c_i$, $d_i$) that are uniquely determined by the twelve numerical conditions:

(1) The positions and directions at the endpoints according to Table I.

(2) The fact that the curvatures at the fiber ends equal zero naturally.

(3) The conditions that the positions, directions and curvatures where sections 1 and 2 join and where sections 2 and 3 join be correspondingly equal. These are expressed numerically by substituting the axial coordinates $x_{ij}$ of the joints between sections i and j ( i, j=1, 2 or 2, 3) as found from Table I into the equations:

$$r_i(x_{ij})=r_j(x_{ij})$$

$$r_i'(x_{ij})=r_j'(x_{ij})$$

$$r_i''(x_{ij})=r_j''(x_{ij})$$

where prime denotes the derivative function. In practice, the best way to represent the curve will depend on the method used to form the curvature. For example, if the curvature is enforced by use of a molding surface in the shape of the optimum curve as described in the preferred method below, the input required for numerical machining of the surface will dictated the most convenient form. This may be the twelve coefficients ($a_i$, $b_i$, $c_i$, $d_i$) or some rearrangement thereof. The algebraic solution will be immediately obvious to those versed in the art, and is not discussed further.

Another method of achieving optimum curvature relies on the advantageous property that the elastic polycapillary fiber forms a cubic spline naturally if supported by a stack of four meshes 60. The meshes are positioned near the ends and at the two joints $x_{ij}$ between the cubic sections. It is understood that in such an embodiment, the sections of fiber between the ends and the top and bottom meshes are naturally straight. For this reason, the pre-specified end conditions such as appear in Table 1 can be directly translated to consitions on fiber position and direction at the locations of the top and bottom meshes. On this method, the supporting slots in the meshed determine the radial coordinates $r(x_{ij})$ of the fibers, but not its direction $r_i'(x_{ij})$ since the fiber may still swivel around the support points. For this case, the solution is found by solving for the radial coordinates $r(x_{12})$ and $r(x_{23})$. This determines the location of the slots for the two inner meshes to meet the pre-specified end conditions. Again the algebraic solution will be immediately obvious to those versed in the art, and not described further.

An advantageous property of the optimum cubic spline is that each shorter sublength of the optimum cubic spline is also optimum. Therefore, the inner ones of the polycapillary fibers 40 follow the same curvature as the outer ones except that they are simply shortened such that its exit end is focussed upon the focal point FP. Alternatively, the curvature may be preformed by layer bonding which is discussed below.

Figure 6A:
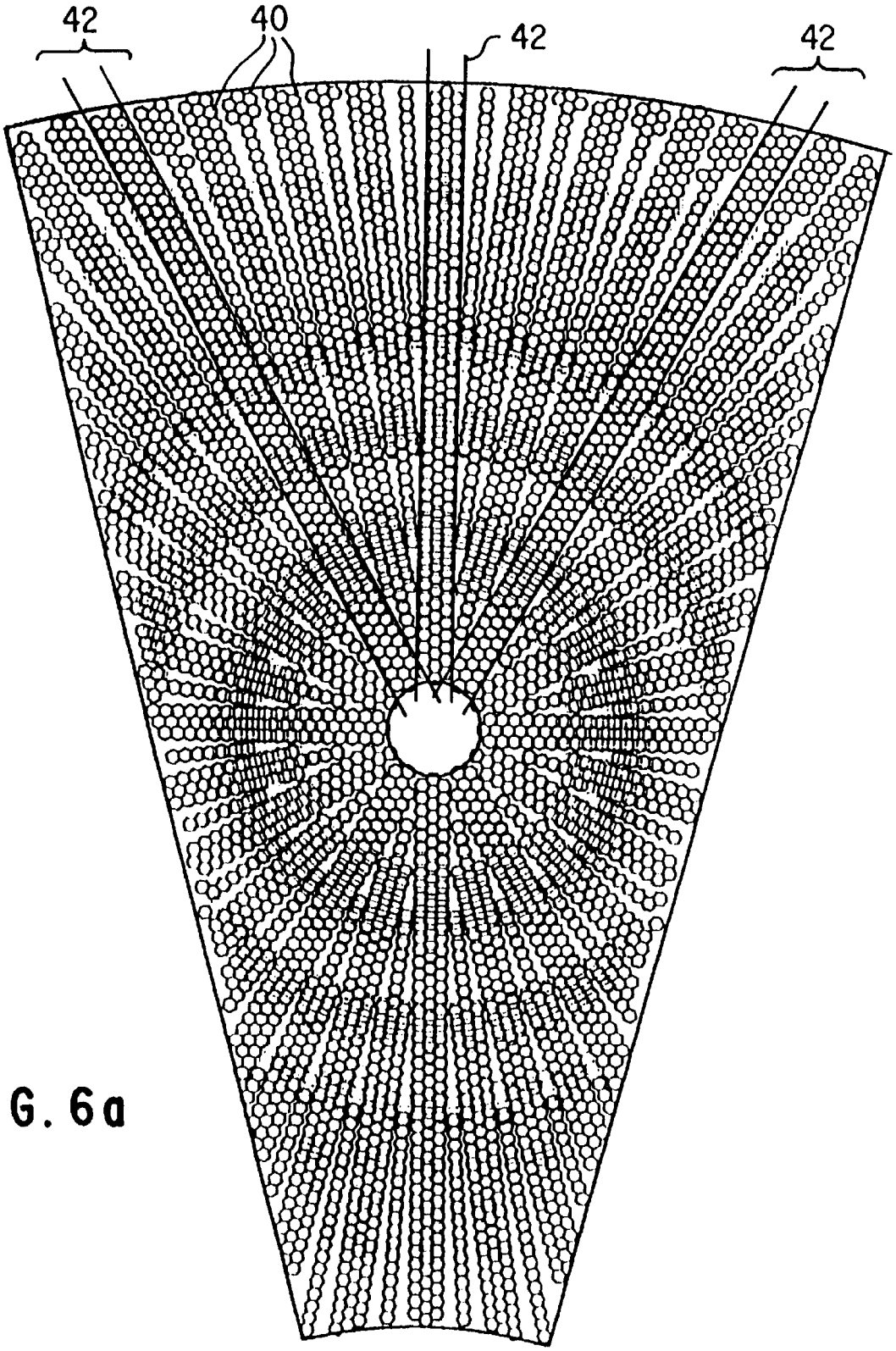
FIG. 6*a* is a front view of an optic module showing entrance and exit ends of the polycapillary fibers superimposed upon one another.

Referring to FIG. 6*a*, a top view of one of the optic modules 22 illustrates the arrangement of entrance ends of the polycapillary fibers 40 at the entrance aperture of the optic module 22. As noted above, while the polycapillary configuration of FIG. 3 is ideally symmetrical about the longitudinal axis LA, due to the wedge shape of the optic module 22, polycapillary fibers 40 are omitted as required to conform to the envelope of the optic module 22. An advantageous construction method is illustrated wherein the polycapillary fibers 40 are arranged in subunit layers 42, three of which are outlined. The subunit layers 42 are disposed radially with respect to the longitudinal axis LA of the optic module 22. The construction of the subunit layers 42 is described in detail below. The use of subunit layers 42 simplifies construction of the optic module 22 and represents a preferred mode of construction of the embodiment of the x-ray telescope 10. However, the construction method may be optionally employed with various other arrangements being realizable by those skilled in the art. Accordingly, the construction method is detailed for exemplary purposes with the scope and spirit of the present invention not being limited thereto.

Figure 6B:
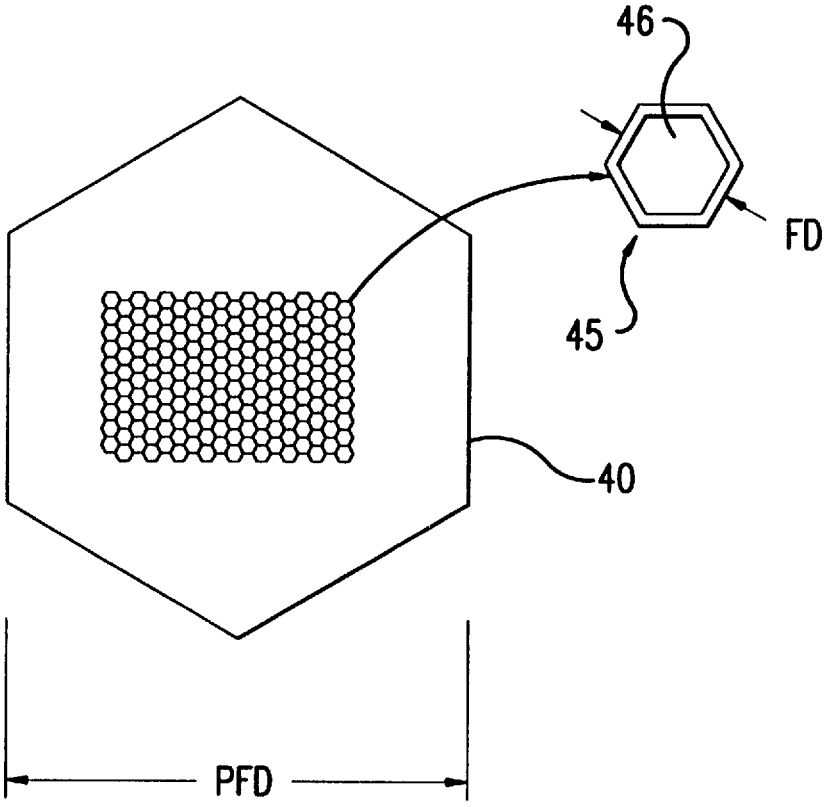
FIG. 6*b* is a simplified cross section of a polycapilary fiber and a cross section of a capillary channel fiber.

Referring to FIG. 6*b*, a cross section of one of the polycapillary fibers 40 shows a portion of numerous capillary channel fibers 45 which form each of the polycapillary fibers 40 and a representative one of the capillary channel fibers 45 in cross section. Both the polycapillary fiber 40 and the capillary channel fiber 45 are preferably hexagonal in configuration to maximize effective surface area by permitting dense packing of the capillary fibers 45 to form the polycapillary fiber 40 and likewise to permit dense packing of the polycapillary fibers 40 in the optic module 22. The capillary channel fiber 45 has a capillary channel 46 and has a flat-to-flat diameter FD in the range of 5'8 $\mu$m and a minimum of a 50% open area. Preferably the flat-to-flat diameter FD is about 6 $\mu$m with a 70% open area when hard x-rays are to be transmitted. If soft x-rays are to be channeled, flat-to-flat diameters up to 35 $\mu$m are usable. The polycapillary fiber 40 has a flat-to-flat diameter PFD in the range of 0.5–2.0 mm and will contain thousands of the capillary fibers 45. In the instant embodiment the polycapillary fiber 40 has a preferred flat-to-flat diameter PFD of about 2.0 mm and is comprised of approximately 80,000 of the capillary channel fibers 45 having the preferred flat-to-flat diameter of 6 $\mu$m. As discussed above, the smaller the diameter of the capillary channel 46, the greater is efficiency is at higher x-ray frequencies. Thus, the goal is to maximize the cross-sectional surface area committed to the capillary channels 46 while minimizing the diameter of the capillary channels 46. There is a tradeoff in the manufacture of the capillary channel fibers 45 where as the diameter of the capillary channels 46 is further decreased, the open area also begins to significantly decrease. It has been found that the diameter of about 6.0 $\mu$m is about optimal using presently available manufacturing techniques. A supplier of a suitable capillary channel fiber is Schott Fiber Optics of Southbridge, Mass. It is realized that the above dimensions may be varied dependent upon the frequency range of x-ray to be channeled and manufacturing techniques employed. The above dimensions being exemplary, such variations in dimensions and along with variations in cross-sectional configuration are considered to be within the scope and spirit of the present invention.

Figure 7:
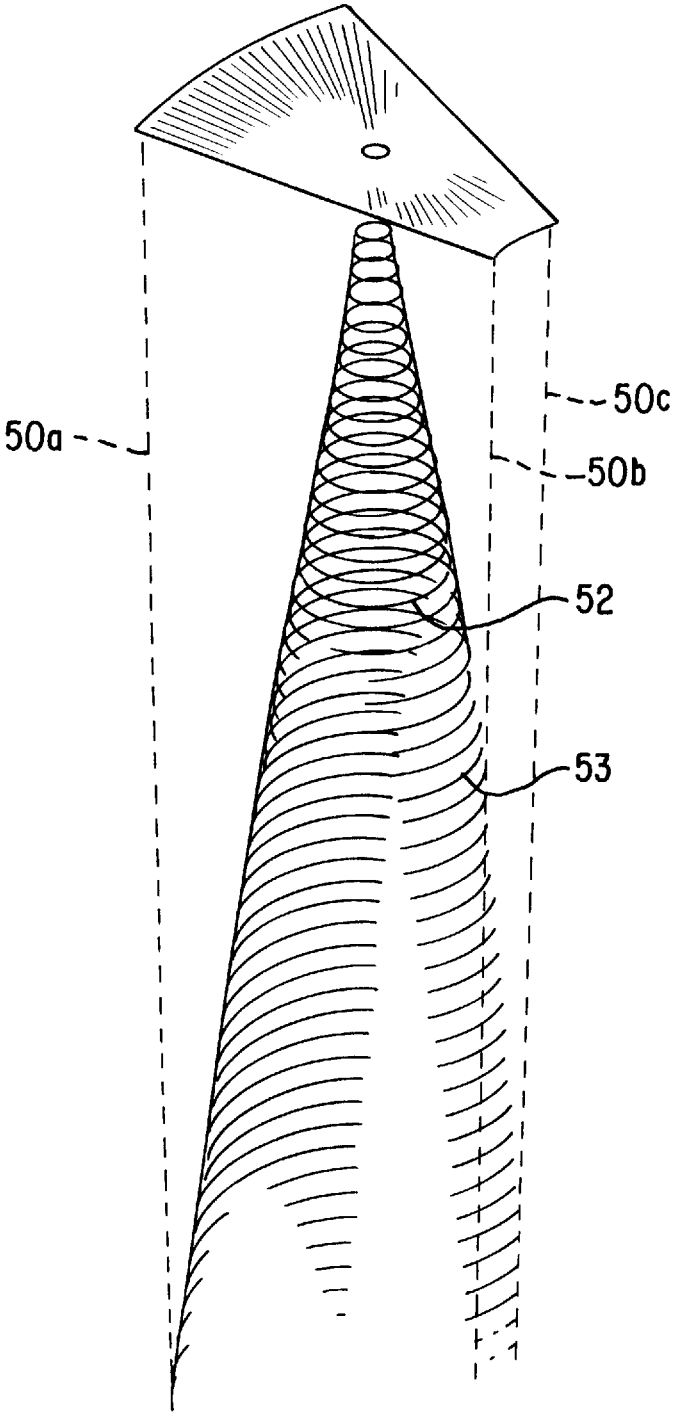
FIG. 7 is computer generated perspective view of a volume occupied by the polycapillary fibers of the optic module.

Referring to FIG. 7, a perspective representation shows an outline of a volume of the assembly of polycapillary fibers 40 of the optic module 22 while omitting detail of the polycapillary fibers 40 themselves. Lines 50*a*, 50*b* and 50*c* represent the edges of the outermost ones of the polycapillary fibers 40 on the visible three corners of the volume with a fourth corner being obscured. Circles 52 and arcs 53 represent exit ends of the polycapillary fibers having a common length. As is evident, inner ones of the polycapillary fibers 40 are shortened in length as their distance to the longitudinal axis decreases to meet focusing conditions discussed above. The arcs 53 represent ends of polycapillary fibers of a given length where a complete circle of polycapillary fibers 40 of the given length are interrupted due to the envelope of the optics module 22.

Polycapillary optics usually have much larger apertures than do conventional fiber optics thus making an efficient assembly method of the optic modules 22 particularly advantageous in the construction of the x-ray telescope 10. Returning to FIG. 6*a*, a preferred method is to construct each optic module 22 using standardized subunits such as the subunit layer 42. The subunit layer 42 is formed from several sheets of close packed fibers all bent in a single plane, the construction of which is described below. The subunit layers 42 are arranged radially with respect to each module's axis and supported by the meshes 60 shown in FIG. 1 and discussed below. The width of a given one of the subunit layers 42, that is the distance from the polycapillary fiber 40 closest to the longitudinal axis to the one furthest from the longitudinal axis will vary dependent upon the particular location in the optic module 22. In particular, certain subunit layers will vary in thickness and will be tapered to fit in between other radially converging subunit layers 42. Since the exit ends of the polycapillary fibers 40 converge toward the longitudinal axis of the optic module 22, it is desirable to pack the exit ends as close together as possible to maximize efficiency of transmission. It is found that when the subunit layers 42 are packed as closely as possible at the detector end, or exit end, they fill 75% of the front annulus. Assuming then 70% open area for each fiber, the geometrical aperture of the x-ray telescope 10 is 900 $cm^2$.

Figure 8:
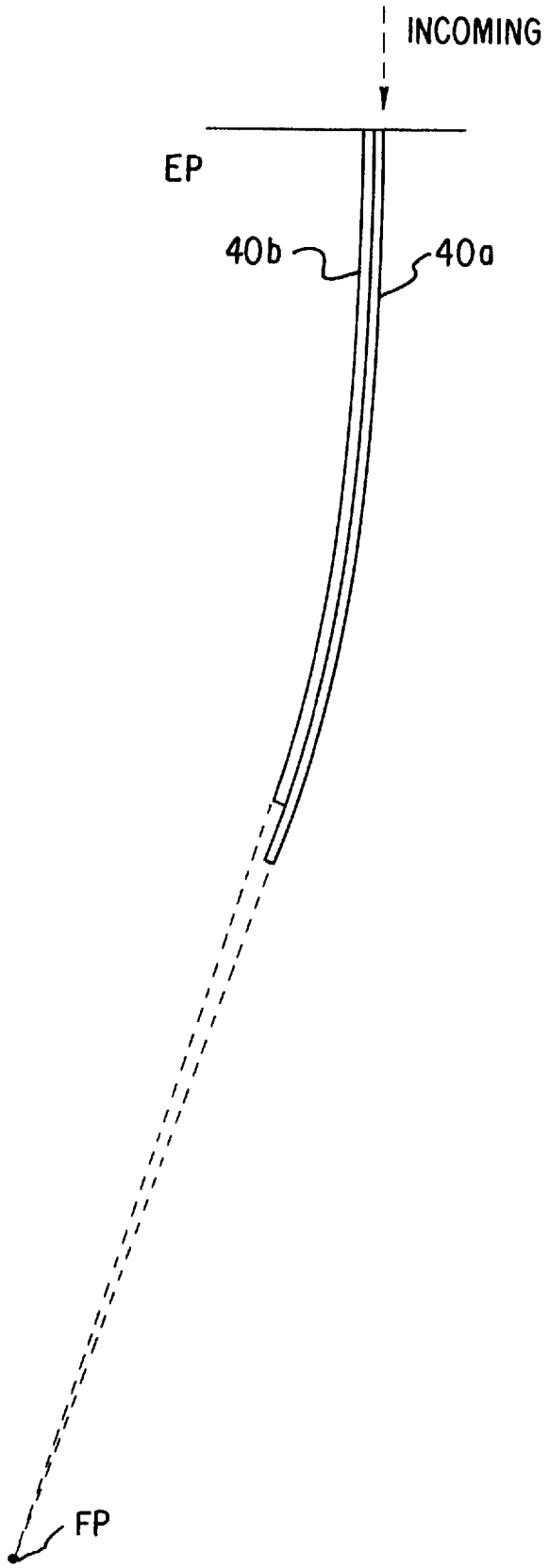
FIG. 8 is a drawing showing two adjacent polycapillary fibers focussed upon a common focal point.
Figure 9:
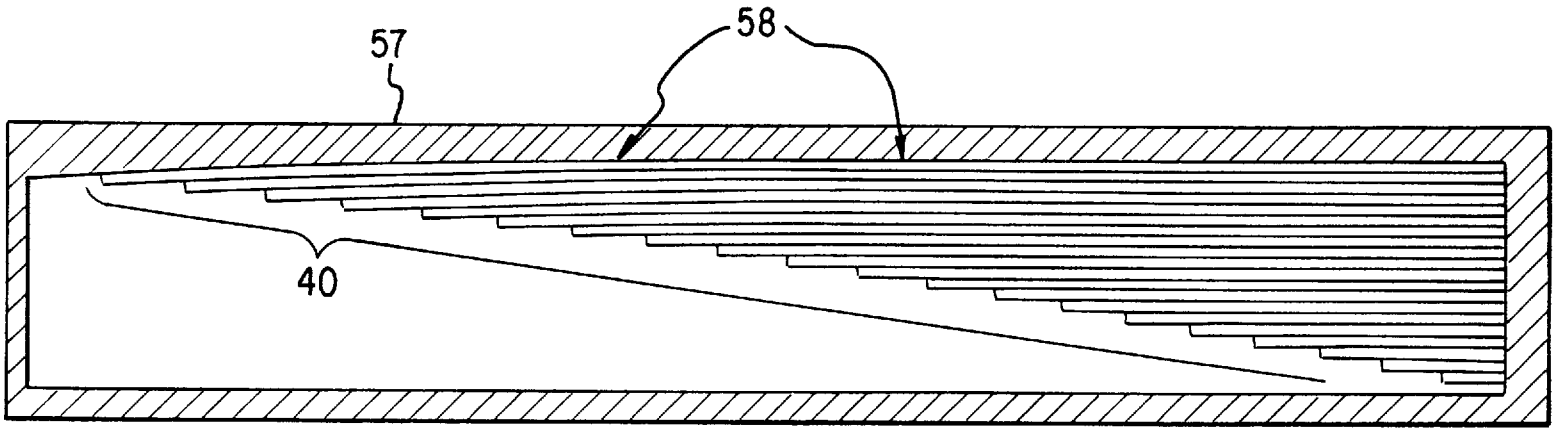
FIG. 9 is a top view of an embodiment of a moulding tray of the present invention.

Besides ease of assembly, use of the subunit layers 42 also presents a way to optimize the overall x-ray efficiency given the geometry constraints. As FIG. 3 shows, each polycapillary fiber 40 in the subunit layer 42 is actually a segment of a single universal curve, the cubic spline. As discussed above, the curve is initially chosen to maximize transmission at high energies at the outer edge of each module. Those of the polycapillary fibers 40 which are closer to the module's axis are shorter since less bending is required. Their lengths are determined by the requirement that the tangent to the curve at its exit be aligned on the detector. Since shorter segments of an optimum-transmitting curve are also optimum, this arrangement provides a best "global" design. The optimum curve proves to be the cubic spline interpolation between a linear front section and a constant curvature bend. Referring to FIG. 8, two adjacent polycapillary fibers 40*a* and 40*b* are disposed abutting one another. Assuming the polycapillary fiber 40*a* is the outermost fiber of one of the subunit layers 42, its curvature is that of the optimum cubic spline and the incoming x-ray beam is focussed on the focal point FP. The polycapillary fiber 40*b* lies abutting the polycapillary fiber 40*a* along its entire length and therefore has the same cubic spline curvature as that of the polycapillary fiber 40*a*. Since the polycapillary fiber 40*b* is disposed radially inward of the polycapillary fiber 40*a*, its length is shorter than that of the polycapillary fiber 40*a* so as to maintain focus upon focal point FP. The fact that both of the polycapillary fibers 40*a* and 40*b* have the same cubic spline curvature is exploited by the subunit layer construction technique. Referring now to FIG. 9, a molding tray 57 for constructing the subunit layers 42 has a shaped inner surface 58 configured in conformance with the optimum cubic spline. The polycapillary fibers 40 are laid in the molding tray 57 abutting each other lengthwise as discussed above thereby each conform to the optimum cubic spline shape of the shaped inner surface 58. Once a layer is formed, the polycapillary fibers 40 are then bonded together using a binding agent such as a rigid epoxy, among various other suitable bonding agents known to those skilled in the art. Second and subsequent layers are then built-up upon the first layer as required and polycapillary fibers are omitted as necessary for the particular subunit layer.

Figure 10:
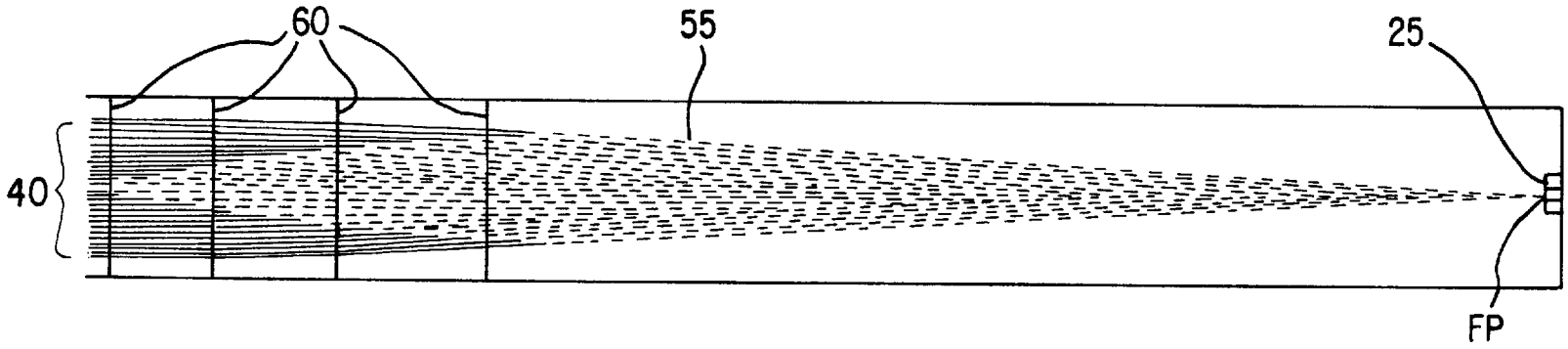
FIG. 10 is a simplified side view of an optic module of the present invention showing x-ray trajectories.

Referring to FIG. 10, a cross-sectional plane of the center of the optic module 22 is shown wherein the polycapillary fibers 40 are focusing x-rays 55 on the focal point FP where the detector 25 measures the intensity of the x-rays 55 collected. The polycapillary fibers 40 are supported by the meshes 60 disposed within the optic module 22. It is advantageous to dispose the meshes at the edges of the three cubic spline sections CS1, CS2, and CS3 discussed above.

Figure 11:
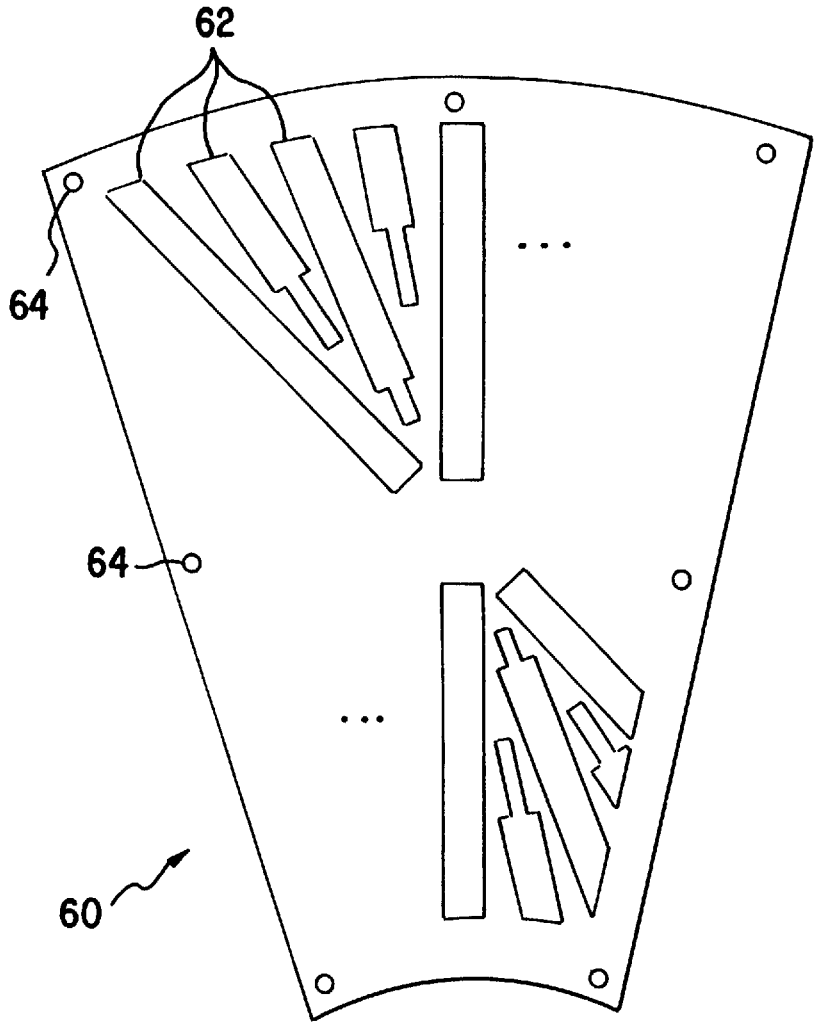
FIG. 11 is a simplified top view of an embodiment of a mesh of the present invention.

Referring to FIG. 11, a simplified drawing of one of the meshes 60 is presented. The mesh 60 is formed from sheet material, preferably a thin sheet (0.100") of copper-beryllium alloy, which has excellent material strength. Slots 62 are formed in the sheet material for accepting and supporting subunit layers 42. It is understood that FIG. 11 presents a simplified depiction of the mesh 60 for the purpose of clarity. In actuality, there are many more slots extending throughout the mesh 60 which are smaller and of more numerous variations in configuration as required for supporting subunit layer 42 having corresponding cross-sectional outlines necessitated for the close packing of the polycapillary fibers 40. Due to the close spacing of the slots 42, photochemical etching is a preferred method of forming the slots 42. Holes 64 are disposed along the periphery of the mesh 60 to facilitate fastening to support flanges with the optic module 22 by means of screws, rivets or similar fasteners. It is realized that alternative mesh configurations, for example, a configuration having holes instead of the slots 62 for supporting polycapillary fibers assembled in bundles instead of layers, may be fabricated by those of ordinary skill in the art. Similarly, alternative fastening techniques such as bonding, for example, may be used to obviate the need for the holes 64 as may alternative metal forming techniques substitute for photochemical etching. Such alternatives are considered to be within the scope and spirit of the present invention.

Referring again to FIGS. 1 and 2, the twelve detectors 25 are disposed on a detector plane 76 in the base of the x-ray telescope 10. While varying types of detectors may be used in the present invention so long as their sensitivity is sufficient over the desired band of operation, preferable types include cooled germanium or spectroscopic grade CdZnTe detectors. The minimum detector diameter is determined by both the spatial concentration and angular divergence of the radiation exiting the fibers. For example, if each subunit layer 42 of the optic modules 22 is made of three close-packed sheets of 2 mm fibers, then the radiation exiting each fiber axially forms a focal point FP in the form of a 2×6 mm focal rectangle on the detector. In general, however, the exiting radiation is angularly distributed even for parallel incident radiation. Assuming this approaches the acceptance distribution 4.0×(50 keV/E) arcminutes FWHM, then the focal rectangle blurs to 9×13 mm at 20 keV. To optimize the sensitivity at hard energies, some loss of efficiency below 20 keV due to detector underfilling of the focal spot is tolerable. Germanium detectors 15 mm in diameter and 7 mm deep provide better than 80% detection efficiency from 20 keV to 100 keV; similar CdZnTe detectors are somewhat thinner. The use of beryllium windows in the detectors extend the Ge bandpass to 3 keV.

Germanium detectors of above dimensions also have significantly better resolution, (165,480) eV at (5.9,122)

keV, than the large area solid-state arrays that have been flown occasionally in the past. Such detectors are available from the EG&G Ortec Corporation. The efficiency characteristic of the optic modules 22 is a smooth and monotonic function at high energies which is another advantage for high resolution spectroscopy. The detector size is small enough to eliminate the need for active shielding. Above 25 keV, where the background is dominated by the 4 $\pi$ leakage of the diffuse photon flux, a 1 mm thick, high-Z collimator around each detector reduces the diffuse photon flux below the particle-induced component.

Figure 12:
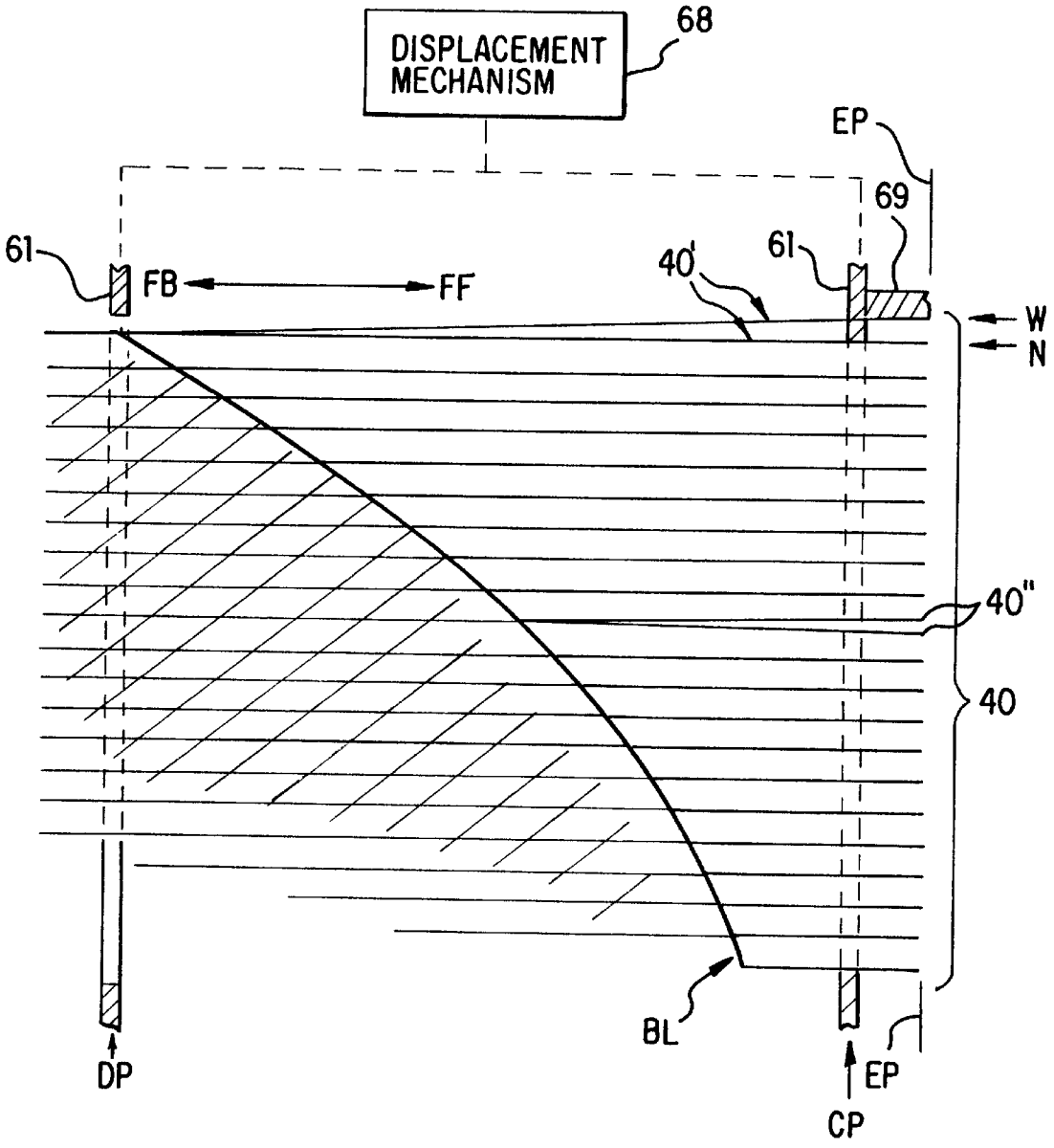
FIG. 12 is a planar view of a section of the optic module showing a partial view of a displacement mechanism of the present invention.

An optional imaging feature of the present invention provides for decollimation of the polycapillary fibers 40 to increase the field of view to approximately 15 arcminute FWHM and incorporation of the Fourier synthesis rotational aperture grid assembly 28 to allow Fourier imaging. Referring to FIG. 12, an embodiment of a decollimation mechanism for implementing the imaging feature is shown wherein the optic module 22 is constructed as discussed above except for modifications described herein. A displaceable decollimation mesh 61 is disposed in place of the mesh 60 shown in FIG. 10 closest the entrance plane EP. The decollimation mesh 61 is displaceable by a displace mechanism 68 in both forward and backward directions, FF and FB respectively. When the decollimation mesh is all the way forward at the collimation position CP against stop 69, an outermost fiber 40' of the polycapillary fibers 40 is held at position N for narrow field operation where it conforms to the natural cubic spline for accepting x-rays entering the x-ray telescope 10 on a path substantially parallel with the longitudinal axis of the optic module 22. In order to widen the field of view it is necessary to decollimate the polycapillary fibers 40. The decollimation is effected by moving the decollimation mesh 61 to a decollimation position DP at which contact with the outermost fiber 40' ceases and the polycapillary fibers splay radially outwards from the longitudinal axis LA of the optic module 22, the outermost fiber 40' settling at position W for wide field of view operation. In the instant embodiment the angle defined by positions N and W of the outermost fiber 40' is preferably 7.5 arcminutes with inner ones of the polycapillary fibers having a decreasing angle of divergence with decreasing distance from the longitudinal axis. For instance, intermediary fiber 40" will define an angle of approximately 3.75 arcminutes between its two extreme positions.

In order to permit splaying of the polycapillary fibers 40, the bonded area of the subunit layer 42 is limited to an area, shown hatched, aft of a bonding limit BL with the remaining area free of bonding. The bonding limit BL is determined by numerical solution of the cubic spline curvature for a given angle of desired deflection. Hence, the bonding limit BL is curved to effect decollimation angles varying in relation to the radial offset. Alternatively, since the cubic spline represents the natural curvature assumed by the polycapillary fibers 40, the polycapillary fiber 40 may be supported solely by meshes 60 with an additional curved mesh with individual holes for the polycapillary fibers serving to define the surface of the bonding limit in place of the bonding material. Specific dimensions will vary dependent upon design goals and calculations therefor and can be carried out by those of ordinary skill in the field of art having the benefit of this disclosure.

As an alternative to the bonding technique described above using rigid epoxy and the bonding limit BL, the polycapillary fibers 40 are bonded together using a flexible epoxy. Since the cubic spline is the natural shape of a fiber between discrete points of support, the subunit layers 42 are bonded together with the flexible epoxy in a generally straight configuration and force is applied by the meshes 60 to deflect the subunit layer 42 into the cubic spline configuration.

Figure 13:
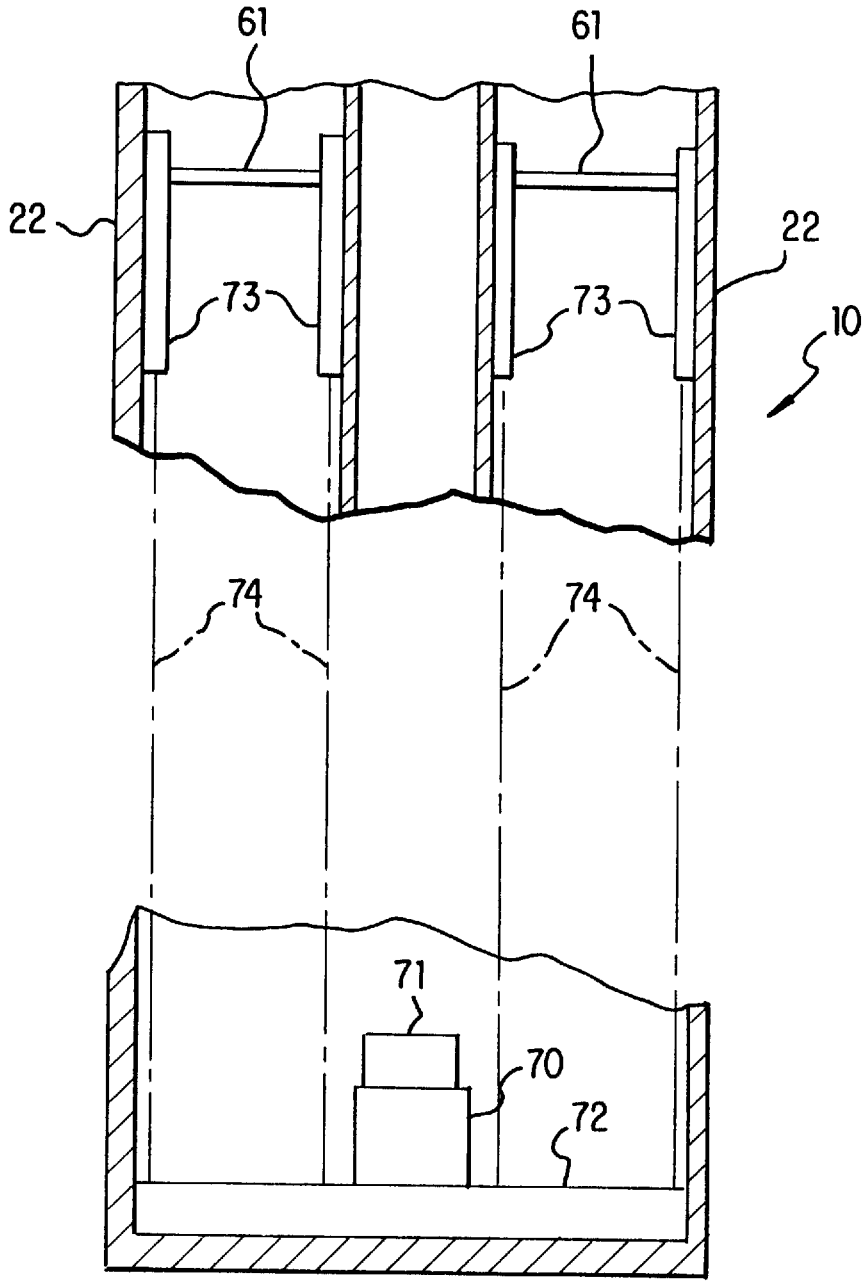
FIG. 13 is a simplified side view of the displacement mecahnism of FIG. 12 omitting the polycapillary fibers and mechanical features not pertinent to the displacement mechanism.

Various types of displacement mechanisms may be adapted by those skilled in the art to drive the decollimation mesh 61. Referring to FIG. 13, an embodiment of the displacement mechanism 68 includes a stepper motor 70 actuated by a control unit 71 to drive a gear mechanism 72. The decollimation meshes 61, including support frames (not shown), are slidably disposed on lead screw slides 73, the lead screws 74 (schematically depicted) being driven by the gear mechanism 72 in a base portion of the x-ray telescope 10. Since the x-rays and polycapillary fibers 40 (not shown) converge toward the longitudinal axis of the optic modules 22, the lead screws 74 do not interfere with the optics of the x-ray telescope 10. Specific details of the displacement mechanism are omitted as they are realizable by those skilled in the art and, therefore, need not be further detailed. Optionally, the displacement mechanism 68 variably positions the decollimation meshes 73 to effect varying fields of view. It is realized that alternative drive mechanisms may be implemented and are considered to be within the scope and spirit of the present invention.

The prior art teaches that polycapillary optics are advantageous in concentrating radiation onto small detectors. However, such optics have no inherent imaging capability, and heretofore there has existed no practical means of providing such a capability. An imaging capability for the telescope can be provided, however, by using a variant of the Fourier rotational aperture synthesis technique employing the Hartley two-dimensional transform. This derives in spirit from the "mock interferometer" design of L. Mertz in which an array of modulation collimators was closely coupled to large volume, non-imaging solid-state detectors for use in gamma ray astronomy described in the paper by L. N. Mertz, G. H. Nakano, J. R Kilner, Rotational Aperture Synthesis for X-rays, J. Opt. Soc. Am. A3, pp. 2167–2170, 1986, and the paper by G. Nakano, J. Kilner, M. Murphy, M. Vartanian, ANGAS: a New Spaceborne High Resolution Gamma-ray Spectrometer, in Nuclear Spectroscopy of Astrophysical Sources, ed. N. Gehrels, AIP Vol. 170, pp. 432–438, 1988, which are incorporated herein by reference for their teachings relating to system design and inverse Fourier transformation.

Referring to FIG. 1, in the above embodiment of the present invention, the optics assembly 15 is interposed between the aperture grid assembly 28 and the detectors 25 to concentrate, or focus, the x-rays as discussed above. This construction has the virtue that neither the imaging nor the spectroscopy functions of the x-ray telescope 10 is compromised and the simplicity of non-imaging detectors 25 is retained. Furthermore, a well-formed point response function which yields an increased dynamic range after standard deconvolutions (e.g. CLEAN, a known radio astronomy technique for filtering) are applied is obtained. For crowded fields, this is necessary to exploit the full sensitivity of the x-ray telescope 10. The operation of the decollimation mesh 61 provides 1.5 arcminute FWHM imaging across an extended 15 arcminute field-of-view as discussed above. Since the required increment in direction from one polycapillary fiber 40 to the next is small compared to their acceptance angles, it is possible to obtain a nearly flat field, with little vignetting, whose size is almost energy-independent above 15 keV.

Figure 14A:
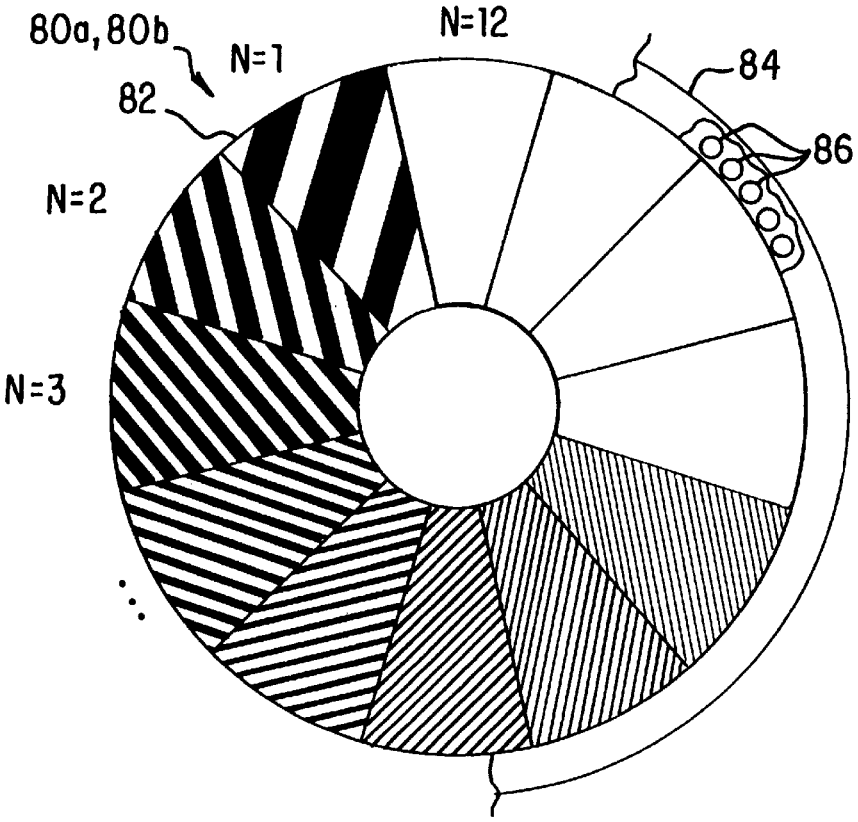
FIG. 14*a* is a plan view of grids of an aperture assembly of the present invention wherein grid spacings are greatly enlarged for clarity and depictions of grids for N=9 to 12 are omitted due to resolution limitations.
Figure 14B:
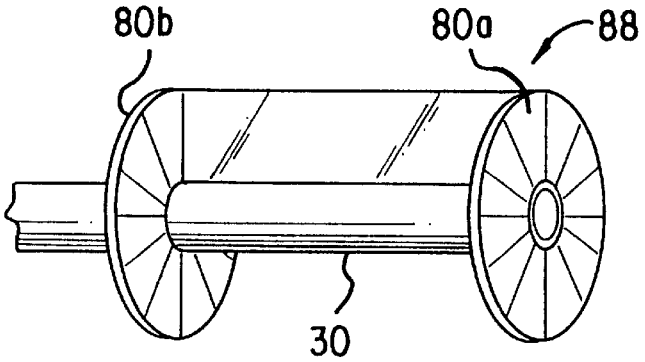
FIG. 14*b* is a side perspective view of grids of the aperture assembly of the present invention omitting grid detail.

The Fourier aperture synthesis method measures one-dimensional, sinusoidal-like components of a sky brightness distribution. Each of the optic modules 22, with its associate one of the detectors 25, is used to measure a separate angular frequency. Referring to FIGS. 14*a* and 14*b*, the grid assembly 28 includes entrance and exit grids, 80*a* and 80*b* respectively, each partitioned into corresponding twelve grid sections 82 (not shown in FIG. 14*b*). The entrance and exit grids 80*a* and 80*b* are fixedly mounted spaced apart on the rotating core shaft 30. The two grids 80*a* and 80*b* are rotatably mounted in a tubular grid housing 84, which may be integral with a tubular housing of the overall x-ray telescope 10 or attachable thereto, using roller bearings 86 riding within races (not shown) thus forming a rotating grid carousel 88. The carousel 88 is rotated by torque applied to the rotating core shaft 30 by the motor 32 located proximate the detector plane 76 as shown in FIG. 1. A section partition 87 is shown in FIG. 14*b* and is representative of twelve such partitions (only one of which is shown) extending radially from the rotating core shaft 30 and interconnecting the two grid layers 80*a* and 80*b* at the boundaries of the twelve grid sections 82. The section partitions 87 serve to isolate operational areas of corresponding pairs of grids sections 82 from that of other ones of the grid sections 82.

For astronomical applications, it is critically important that the entrance aperture of the x-ray telescope 10 be large enough to collect sufficient x-rays from distant stars. The telescope must therefore be packed with the polycapillary fibers 40 in a most efficient manner as described above with regard to the polycapillary optics assembly 15. Mertz Fourier implementation of the indirect imaging method requires an array of separate detector-grid combinations. In the present invention however, the separate detector-grid combinations are optimally implemented arranging the twelve grid sections 82, annular in configuration, with respective ones of the optic modules 22, with each of the optic modules 22 focussing on its associated one of the twelve detectors 25. As is further discussed below, the asymmetrical geometry for each of the optic modules 22 has the additional advantageous property of being able to measure x-ray polarization when the x-ray telescope spins around its axis.

Mertz' method is basically a Fourier analysis of the x-ray distribution across the sky into its various sine and cosine components. X-rays from various directions will be transmitted or blocked by the two sets of opaque grids depending on how the shadow of the entrance grid falls on the exit grid. The net effect is to produce a " . . . bright-dark-bright-dark . . . " acceptance pattern that is approximately sinusoidal. A signal produced by a respective one of the detectors 25 is the amplitude of the associated Fourier component. The combination of the twelve grid sections 82 generates a one-dimensional Fourier transform of the x-ray distribution, and a two-dimensional transform is measured as the grids 80*a* and 80*b* rotate with respect to the sky. Finally, the complete set of these detector-angle signals is "inverse Fourier transformed" by using a digital computer using standard algorithms. The result is an image of the original x-rays.

A critical feature of the Fourier method is that an integral number (1,2,3 . . . , N) of these "bright-dark" fringes must fall within the field-of-view of the x-ray telescope 10. (The "field-of-view" is the area of sky the telescope images.) This condition is automatically met in prior designs (i.e. without using polycapillary optics), since the field-of-view is simply determined by the geometrical overlap of the two Fourier grids. However, in the present invention the field-of-view of the polycapillary optics 40 of each of the optic modules 22 is determined by the maximum angle that x-rays can enter the polycapillary fibers 40 and be efficiently transported to a respective one of the detectors 25 (analogous to the "numerical aperture" for standard fiber optics). This maximum angle depends on the x-ray energy. Therefore, if all the fibers were simply co-aligned at the entrance, not only would it be impossible to insure an integral number of fringes for all energies, but the field-of-view would be much too small to use the Fourier technique. Hence, the above described decollimation mesh 61 is employed to permit use of the Fourier technique by expanding the field-of-view to overcome prior art drawbacks. With the field-of-view being extended by deliberately decollimating the polycapillary fibers 40, any variation due to energy will be relatively small. The amount of decollimation is limited by the requirement that there be sufficient overlap in the fields-of-view of adjacent ones of the polycapillary fibers 40 (pointing in slightly different directions) so that the total acceptance is smooth.

In some situations, however (e.g. when the x-rays come from a single star) there is no need for imaging, and it is better to concentrate the field-of-view in a single direction. For this reason, the field-of-view is made variable by actuating the decollimation mesh 61 to collimate the polycapillary fibers 40 by displacement to the collimation position CP.

Referring again to FIG. 14*a*, an arrangement of the twelve Fourier synthesis grid sections 82 is shown. The spatial scale is greatly magnified for clarity in the illustration. The essence of the Fourier aperture technique is that a width of the opaque bars, and the spacing between the two grid planes, be such that an integral number of (quasi-) sinusoidal periods subtend the field-of-view of the optics assembly 15 of each of the optic modules 22. It is important to note that the field-of-view for the x-ray telescope 10 is formed by decollimating the polycapillary fibers 40 through the use of the decollimation mesh 61, and is not determined by the overlap of the shadow of the entrance grid plane with respect to the exit grid plane as has been done heretofore. The fact that the field-of-view is formed this way is immaterial to the Fourier imaging, but this means that the number of bars comprising a grid plane does not have the direct relation as in previous Fourier imaging devices.

Figure 14C:
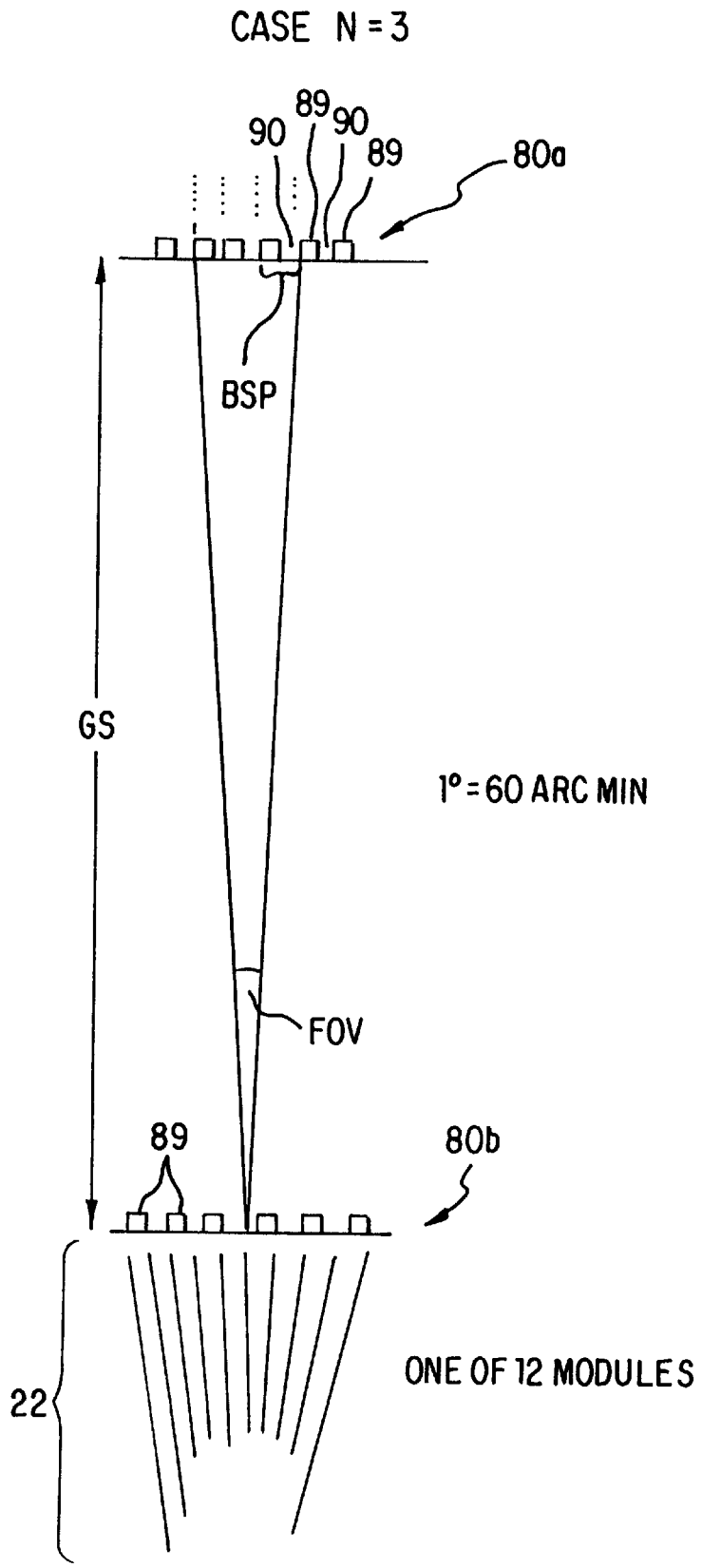
FIG. 14*c* is a side view depiction of an embodiment of grid spacing requirements for the present invention.

Referring to FIG. 14*c*, in the embodiment of the present invention it is required that an integral number N (N=1, 2, 3, . . . , 12) of bar-space periods BSP at the entrance grid 80*a* subtend the fifteen arcminutes field-of-view FOV at the exit grid 80*b*. Each bar space period equals the width of a bar 89 width plus a width of one space 90 where the two are equal. In FIG. 14*c*, a grid configuration is illustrated for the case that N=3. That is, the field-of-view FOV subtends three grid periods. A grid spacing GS of 80 cm is used in the present embodiment, therefore the corresponding width of a bar-space period is 0.352/N cm. In the present embodiment the coarsest grid period is 0.352 cm, the finest is 0.0293 cm=293 micrometers, and grid phasing between entrance and exit layers 80*a* and 80*b* is offset by an eighth of the grid period.

Fabrication of the grids 80*a* and 80*b* is well within the state of the art of photolithographic etching (chemical machining). The material and the thickness (depth) of the bars 89 is determined by the requirement that the bars 89 be opaque to x-rays at the highest energies contemplated (about 80 KeV), that is, a high atomic number material. One-half millimeter thick tungsten suffices. The grid planes are optionally supported by a thin substrate formed from a low atomic number material for mechanical integrity. In FIG. 14*a*, an angle of the bars 89 within each module is slanted about 45 degrees from the radial direction. However, this is immaterial in the design.

As discussed above, in the preferred embodiment the x-ray telescope 10 rotates continuously around its longitudinal axis with respect to the sky. On the deployment platform, the x-ray telescope 10 is supported by a 3-axis gimbal mount. Apparatus for gimbal mounting and rotation of the x-ray telescope 10 is readily implemented by those of ordinary skill in the art. In the preferred embodiment, which includes polarimetric as well as imaging functionality, the carousel 88 furthermore rotates in twelve incremental steps with respect to the optic modules 22 which are fixed with respect to the body of the x-ray telescope 10. The polarimetry function is discussed below. In an alternative embodiment without polarimetry, the carousel 88 is fixedly mounted to the optic modules 22 eliminating the need for rotatably mounting the carousel 88, the motor 32 and rotating core shaft 30.

Another basic improvement over Mertz' design is provided by using polycapillary optics. Mertz needs two ("sine" and "cosine") collimators for each spatial frequency. The use of two collimators is not necessary for imaging but is advantageous in situations where the detector background is high. Since the background is low using polycapillary optics, one collimator for each spatial frequency suffices. The two grids in the collimator are displaced ⅛ period with respect to each other which corresponds to the use of the Hartley vs. the Fourier transform as describe in the teachings of R. Bracewell, The Hartley transform, Oxford, 1986, which is incorporated herein by reference for its teachings applying the Hartley transform to imaging. The basic improvement lies in the fact that twice the number of spatial frequencies may be accommodated using a fixed number of optic modules 22, so imaging resolution is improved by a factor of two. Accordingly, while "Fourier imaging" is used herein in the general sense, the present invention preferably includes, more specifically, the use of the Hartley transform and its inverse to form images from signals from the detectors 25.

The rotational aperture synthesis imaging concept is now summarized with more information being available in the original paper by Mertz et al. Rotational Aperture Synthesis, as its name implies, is the "mock interferometric" analog of the well-known method by which images are obtained in radio astronomy. It is also related to the technique of rotational modulation collimation, long used in x-ray astronomy to obtain directional information. The principle difference is that for rotational aperture synthesis, as for radio imaging, measurements are distributed throughout the transform (UV) plane, from zero up to a limiting spatial frequency. This gives a response function which, in a sense, optimizes the tradeoff between mainlobe width and sidelobe amplitude, giving what may be called a "true" image.

The transmission characteristic of the grids 80*a* and 80*b* exhibits a triangular modulation pattern which closely resembles a standard sinusoidal fringe oriented as the projection of the bar pattern on the sky. These fringes have the general form:

$$\text{Transmission} \propto 1+\sin 2\pi(x\,R\cos\Theta+yR\sin\Theta+\alpha),$$

where x and y are sky coordinates and Θ is the position angle of the array, R the spatial frequency, and α a phase to be determined. In this way, the count rate from a single detector measures, depending on a, the real, or imaginary (or a combination thereof) part of the one-dimensional Fourier transform of the sky intensity at that angle Θ, superimposed on a constant bias. If the x-ray telescope 10 or the carousel 88 is then made to rotate, Fourier components are measured successively along circular loci spaced at radii R, in the UV plane, where R, is the number of bars across the aperture of detector I. If R, is chosen as {1, 2, 3 . . . } then an unaliased image (i.e. without a grating response) can be reconstructed within the FWMH field-of-view (FOV) of the optic modules. The image is formed by applying the inverse transform after removing the constant bias from the data.

Although quite similar to image formation in radio earth rotation synthesis, there is also an important difference: the spin axis of the x-ray telescope 10 may be reoriented as desired. The common practice in radio astronomy is to track sources for just 12 hours, (since only circumpolar sources are visible for a full day), taking complex measurements at each position. For rotational aperture synthesis, on the other hand, one need take only a single (real-valued) measurement at each position since all sources within the FOV are above the "horizon" for the full "day". The distinction is precisely that between the Fourier transform and the Hartley transform. The Hartley transform has the advantage that, for a given number of detectors, it allows measurements up to twice the spatial frequency, affording double the resolution. As discussed, when using the Hartley transform the grid phasing angle α=⅛ the bar period.

The Hartley image reconstruction is as follows. To a good approximation, the grid transmission is taken as pure sinusoidal. The x-ray image is represented as a two-dimensional pixel array $F_{xy}$ where the sky coordinates (x,y) are selected from −1 to $+_1$ over the field-of-view. The quantities $F_{xy}$ are in units of spectral brightness, i.e. x-rays per $cm^2$ -sec-pixel-keV. The number of pixels is chosen so that the pixel size is much finer than the resolution of the instrument. In the present embodiment, a 40×40 pixel image is sufficient.

The number D(R, Θ,E) of x-rays detected in the energy bin centered at E by the module with grids of spatial frequency R (R=1, 2, . . . 12) during times when the grids are at angle Θ with respect to the sky is:

$$D(R,\Theta,E)=S(R,\Theta,E)+B(R,\Theta,E)$$

with:

$$S(R,\theta,E) = \sum_{x,y=-1}^{1}\left(\frac{ATF_{xy}(E)}{MN}\right)\{1+\sin 2\pi[(x\,R\cos\theta+y\,R\sin\theta)+1/8]\}$$
$$= \sum_{x,y=-1}^{1}\left(\frac{ATF_{xy}(E)}{MN}\right)\left[1+\left(\frac{1}{\sqrt{2}}\right)(\sin\phi+\cos\phi)\right]$$

where:

$$\phi=\phi_{xyR\Theta}=2\pi(xR\cos\Theta+yR\sin\Theta).$$

S and B are the detector counts from the source and background, respectively; A, T, M, and N are the total effective area, observation time, and maximum spatial frequency (in the described embodiment N=12). The number of angular measurement bins M should be chosen to be greater than πN. Here, M=40 is sufficient where N=12 in the described embodiment. These are transformed into quantities $D_0(R, \Theta)$ with zero mean that represent the Hartley transform of the sky brightness distribution:

$$D_0(R,\theta) = D(R,\theta) - \left(\frac{1}{M}\right)\sum_{\theta=0}^{M-1} D(R,\theta) = \sum_{x,y=-1}^{1}\left(\frac{1}{\sqrt{2}}\right)\left(\frac{ATF_{xy}}{MN}\right)(\sin\phi + \cos\phi) + [B(R,\theta) - \overline{B}],$$

where:

$$\overline{B} \equiv \left(\frac{1}{M}\right)\sum_{\theta=0}^{M-1} B(R,\theta)$$

The image is reconstructed by applying the inverse Hartley transform:

$$F_{xy}(\text{recon}) = \left(\frac{\sqrt{2}}{AT}\right)\sum_{R=1}^{N}\sum_{\theta=0}^{M-1} D_0(R,\theta)(\cos\phi + \sin\phi)$$

$$= \sum_{\xi,n=-1}^{1} R_{xy\xi\eta}F_{\xi\eta} + N_{xy}$$

where:

$$R_{xy\xi\eta} \simeq \frac{1}{MN}\sum_{R=1}^{N}\sum_{\theta=0}^{M-1}\cos(\phi_{xyR\theta} - \phi_{\xi\eta R\theta})$$

and:

$$N_{xy} = \frac{\sqrt{2}}{AT}\sum_{R=1}^{N}\sum_{\theta=0}^{M-1}[B_0(R,\theta) -](\cos\phi\sin\phi)$$

$R_{xy\xi n}$ represents the characteristic sidelobes of the point response function which can be filtered by applying the standard CLEAN technique as discussed above. $N_{xy}$ is the noise fluctuation with expectation value zero caused by the residual detector background.

It is further possible to obtain a polarimetric response using the x-ray telescope 10 of the present invention. In principle, a bent polycapillary fiber may exhibit a dichroic (i.e. efficiency) response to radiation linearly polarized parallel or perpendicular to its plane of curvature. Such an effect may be caused, for example, by tunneling losses from highly curved surfaces. A. W. Snyder and J. D. Love, Optical Waveguide Theory, Chapman and Hall, London, 1983. Since an optical module would retain a net polarimetric moment due to its asymmetrical aperture, the x-ray transmission from a polarized source would also be rotationally modulated. The polarimetry function requires the second rotational motion wherein the grid carousel 88 is incremented with respect to the optic modules 22. The polarimetry depends on the angle of the modules 22 with respect to the sky. The imaging depends upon the angle of the grids 80*a* and 80*b* with respect to the sky. When these two rotational frequencies are different, the polarimetric and the imaging signals are decoupled.

In a co-aligned mode, precision in alignment and attitude control dictate limits to performance. For parallel fibers, the angular acceptance is 4.0×(50 keV/E) arcminutes FWHM above 20 keV. This means that below 60 keV at least 80% of the on-axis area will be available within a 2 arcminute diameter error circle. Presently, rocket and balloon control systems are available which are sufficient for controlling the x-ray telescope 10 when installed on such platforms to permit real-time "joystick" control of the x-ray telescope 10 allowing pointing to better than one arcminute. Accordingly, details of such systems are omitted from this description. Furthermore, enhancement of the control of the x-ray telescope 10 is possible using the x-ray signal in controlling pointing directly since the background noise is low.

Instrumental sensitivity.

Figure 15A:
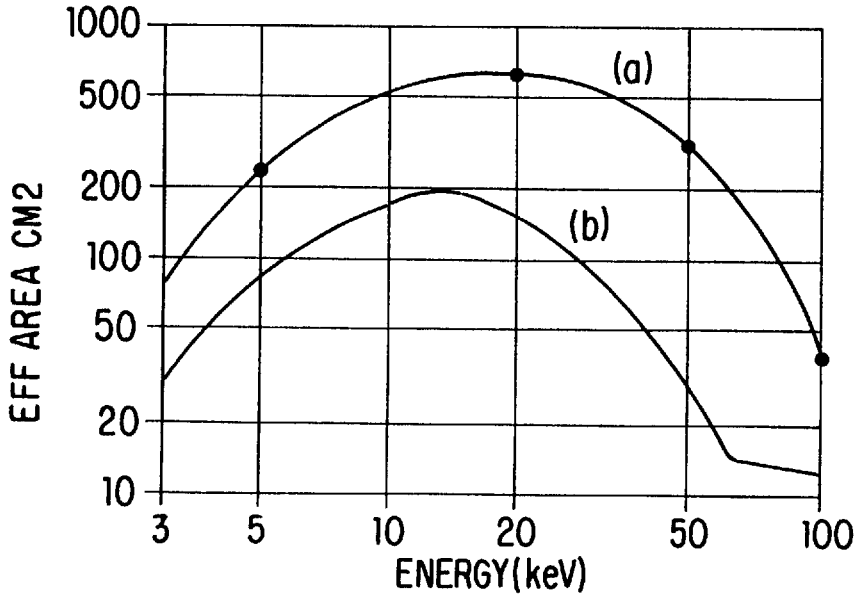
FIG. 15*a* is a showing effective area versus energy level for imaging and non-imaging modes of operation.

Under ideal conditions, the above described embodiment of the x-ray telescope 10 will yield 36 signal counts—and no background counts—in a 300 eV bin at 60 keV in 150 seconds with the reference source being the Crab Nebula. Referring to FIG. 15*a*, calculations of the theoretical effective area versus energy for the described embodiment in both the imaging mode and the non-imaging mode, without the grids 80*a* and 80*b* characterize expected performance of the x-ray telescope 10. Monte Carlo ray-tracing code for 6 $\mu$m channel diameter borosilicate fibers with 70% open area is used. The calculated effective area is for point sources on the longitudinal axis LA. Curve (a) is for the non-imaging mode while curve (b) is for the imaging mode. The calculated effective area is reduced due to blockage by the grids 80*a* and 80*b*, distribution of the effective area over the field-of-view. Effective area is also reduced by the need to allow margin at the edge of the optic modules 22 for the polycapillary fibers 40 to decollimate, but this loss is offset by having less curvature of the polycapillary fiber 40 in the decollimated imaging mode. The fall-off below 20 keV is from the detectors 25 underfilling the focal spot.

Figure 15B:
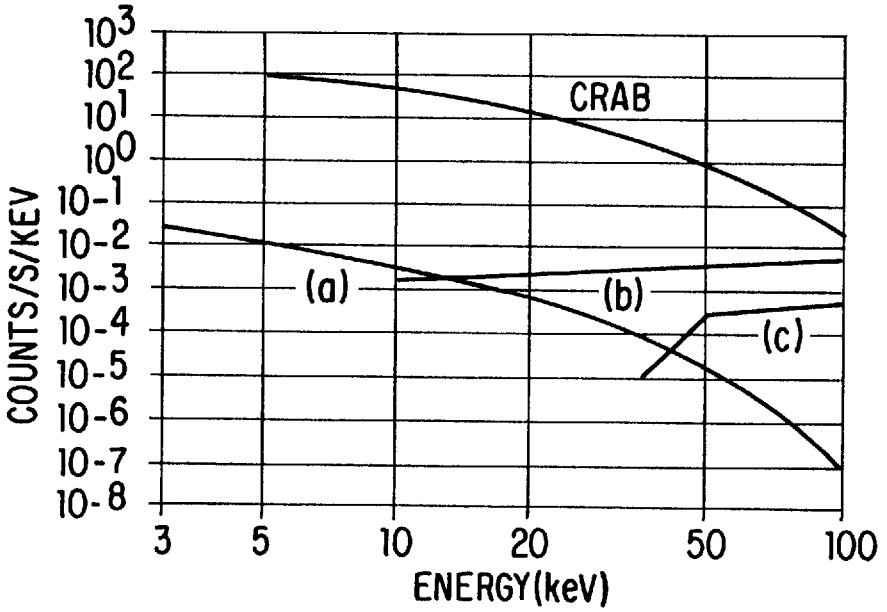
FIG. 15*b* is showing (a) diffuses flux, (b) particle flux, and (c) $4\pi$ diffuse flux with minimal shielding versus energy level.

The particle-induced, aperture diffuse, and 4$\pi$ diffuse components of the background are calculated by scaling standard background reference data using simple geometry. Referring to FIG. 15*b*, curve (a) is for aperture diffuse flux, curve (b) for particle-induced, and curve (c) is for 4$\pi$ diffuse flux with minimal passive shielding in the non-imaging mode wherefor the total background over the twelve detector array is 5 milliCrab at 60 keV.

For source flux-limited observations, $F\epsilon At\,\Delta E \ll Bt\,\Delta E$ (where F is the source continuum flux, the other symbols having their usual meanings), and the time needed to make a 3$\sigma$ measurement is $$t_{3\sigma} = \frac{9}{F\epsilon A\Delta E}$$

Figure 15C:
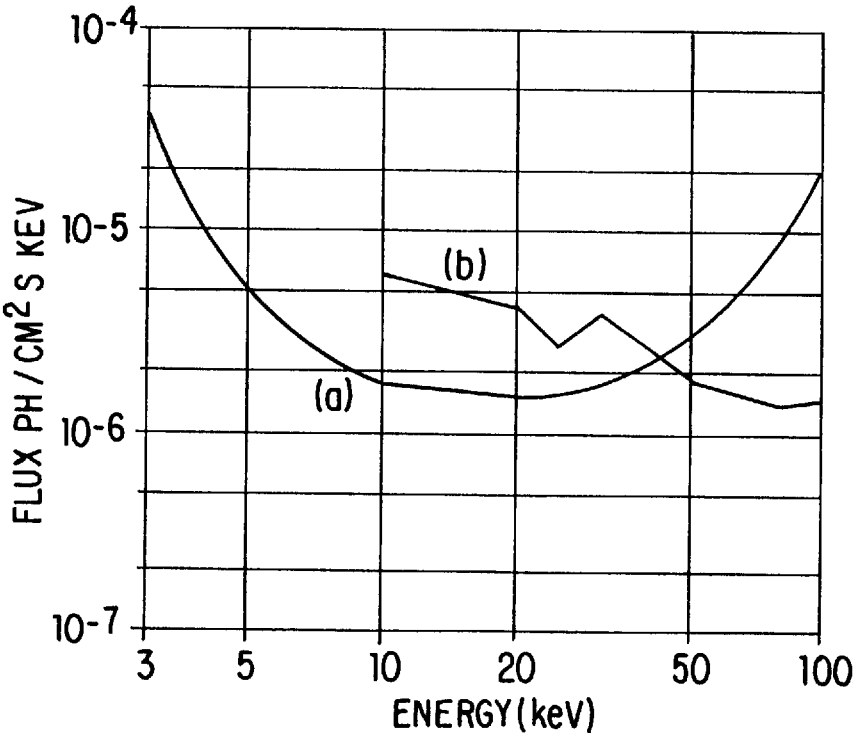
FIG. 15*c* is a graph showing flux versus energy level for (a) the embodiment of FIG. 1 and (b) the HEXTE telescope.

In a background-limited situation, the 3$\sigma$ minimum detectable flux $F_{3\sigma}$ is found by requiring $$F_{3\sigma}\epsilon At\Delta E = 3\sqrt{2Bt\Delta E}$$

where equal on- and off-source times are assumed. $F_{3\sigma}$ is shown in FIG. 15*c* for $t=10^5$ second observation using a resolution bin width $\Delta E$=1 keV. It is interesting to note that the continuum sensitivity for the x-ray telescope 10, curve (a), is better, or comparable, to that of HEXTE below 60 keV, curve (b), but with better resolution. Although the sensitivity is displayed only for non-imaging case, the same plot applies to imaging if the bin size is taken as the ratio of effective areas in FIG. 15*a*. The narrow line sensitivity will be discussed elsewhere.

Figure 16:
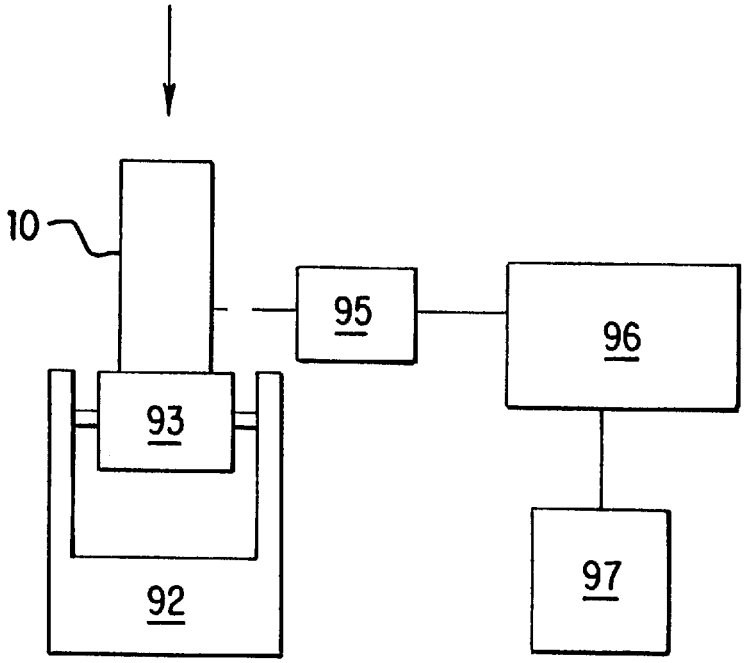
FIG. 16 is a block diagram schematic of an embodiment of the system of the present invention.

Referring to FIG. 16, when deployed for operation, the x-ray telescope 10 is mounted on a gimbal system 92 to effect accurate pointing and stabilization of the x-ray telescope 10. An external rotation unit 93 is used to rotate the x-ray telescope 10 to accomplish the Fourier imaging with the carousel 88 fixed. Optionally, in addition, the carousel is rotatably mounted to the x-ray telescope as described above to accomplish the polarimetric function. Outputs from the detectors 25 are inputted to a transmitter 95 for transmission to a ground-based computer 96 for analysis. It is realized, however, that computing may be distributed between or shifted to the x-ray telescope 10 dependent upon deployment platform constraints and mission requirements. The computer 96 is programmed to perform the Fourier imaging calculations and produce the resulting images upon a display device 97, which may be either a video display device or a hardcopy output device. In the preferred embodiment the computer applies the Hartley transform to produce the images.

Many practical issues are solved by the proposed invention, in an optimal way. First, since x-ray telescopes can be used only above the Earth's atmosphere (through which x-rays do not penetrate), the telescope is commensurate with actual space platforms available such as research rockets, high-aititude balloons, satellites or space stations. Second, the present invention provides an x-ray telescope for Fourier synthesis imaging that significantly extends the usefulness of such an instrument without compromising its high sensitivity for discrete sources. It has also been designed for flexibility as to launch mode to facilitate use and to allow observations down to soft energies.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An x-ray apparatus for use in imaging an object, comprising:

detectors for detecting x-rays;

optic modules, each of said optic modules being disposed in front of a respective one of said detectors and having an optical axis aligned therewith, each of the optic modules having polycapillary fibers with entrance ends open to an entrance aperture of the x-ray apparatus and exit ends aligned to direct x-rays entering the entrance ends to said respective one of said detectors, said polycapillary fibers being decollimated at said entrance ends to provide a predetermined field-of-view;

a Fourier grid assembly disposed in front of said optic modules and having pairs of entrance and exit grids each aligned with a respective one of said optic modules, said pairs of entrance and exit grids having spaced apart bars with a bar spacing period such that an integral number of bar spacing periods at said entrance grid subtends said predetermined field-of-view of said polycapillary fibers, said entrance and exit grid pairs having more than one integral number of bar spacing periods; and means for rotating as a whole said optic modules, said detectors and said Fourier grid assembly with respect to said object to acquire imaging data from said detectors.

2. The apparatus according to claim 1 wherein:

said optic modules have said polycapillary fibers asymmetrically arranged with respect to said optical axes thereof to permit detection of polarimetry data; and said apparatus further includes means for rotating said Fourier grid assembly with respect to said optic modules to successively align respective ones of said entrance and exit grid pairs with respective ones of said optic modules to acquire both said polarimetry data and said imaging data from said detectors by independently modulating said imaging data and said polarimetry data to permit separation thereof.

3. The apparatus according to claim 1 wherein said polycapillary fibers are bent along a path of a natural cubic spline and are of varying lengths as determined by tangential points on said polycapillary fibers whereat a straight line from said at least one detector tangentially intersects said natural cubic spline.

4. The apparatus according to claim 1 wherein said entrance and exit grids are phased apart by ⅛ of said bar spacing period.

5. The apparatus according to claim 4 further comprising:

calculating means for applying Hartley transform techniques to said imaging data to produce an image of said object; and means for transmitting said imaging data to said calculating means.

6. The apparatus according to claim 1 wherein said at least one optic module includes means for moving said polycapillary fibers at said entrance ends to positions which are collimated.

7. The apparatus according to claim 6 wherein said means for moving includes:

a mesh having apertures for receiving said polycapillary fibers, said mesh being slidably mounted in said optic module to slide along said optical axis between a retracted position, whereat said mesh is removed from said entrance ends of said polycapillary fibers to allow said polycapillary fibers to splay radially outward to decollimated positions, and a forward position proximate said entrance ends whereat said mesh is moved into contact with outermost ones of said polycapillary fibers to displace said polycapillary fibers into collimated positions; and means for moving said mesh between said retracted position and said forward position.

8. An optic module for focusing x-rays onto a focal point, comprising:

polycapillary fibers arranged in subunit layers radially disposed about an optical axis of said optic module, in line with said focal point, said subunit layers having an inside edge closest to said optical axis and an outside edge furthest from said optical axis;

said polycapillary fibers of each of said subunit layers being configured along a path of a natural cubic spline, having entrance ends disposed at an entrance plane of said optic module, and having varying lengths as determined by exit ends disposed at tangential points on said polycapillary fibers whereat a straight line from said focal point tangentially intersects said natural cubic spline;

said subunit layers including a plurality of single layers of said polycapillary fibers stacked upon one another; and means for fixing said subunit layers about said optical axis.

9. The optic module according to claim 8 wherein said polycapillary fibers in said subunit layers are bonded together.

10. The optic module according to claim 9 wherein:

said polycapillary fibers are bonded together from a boundary proximate said entrance ends to said exit ends and are not bonded between said boundary and said entrance ends; and said boundary is determined by a range of predetermined angular divergences of individual ones of said polycapillary fibers with respect to said optical axis whereby said entrance ends of said fibers are decollimated by splaying of said individual ones of said polycapillary fibers from said optical axis to achieve a desired field-of-view.

11. The optic module according to claim 8 wherein said entrance ends of said polycapillary fibers are held in a collimated configuration.

12. The optic module according to claim 8 wherein said entrance ends of said polycapillary fibers are held in a decollimated configuration.

13. The optic module according to claim 8 wherein said means for means for fixing are a plurality of meshes with slots therein for accepting said subunit layers where said slots are dimensioned and disposed to maintain the cubic spline configuration of the polycapillary fibers.

14. The optic module according to claim 8 wherein said means for fixing is a bonding agent bonding said polycapillary fibers of individual ones of said subunits together in said cubic spline configuration.

15. The optic module according to claim 14 wherein said means for fixing further includes a plurality of meshes with slots therein for accepting said subunit layers where said slots are dimensioned and disposed to maintain the cubic spline configuration of the polycapillary fibers.

16. A method of constructing an optic unit from polycapillary fibers comprising:

disposing a first layer of said polycapillary fibers in a mold tray having a flat bottom and a curve defining inner side surface configured in accordance with a natural cubic spline where an outermost one of said polycapillary fibers is laid on said flat bottom and lengthwise abutting said curve defining inner side surface and remaining ones of said polycapillary fibers of said first layer are laid lengthwise abutting one another and said outermost polycapillary fibers to form a single layer whereby each of said polycapillary fibers is bent in a plane of said first layer to conform to said natural cubic spline;

fixing together said first layer of said polycapillary fibers using an adhesive agent;

disposing and fixing together a predetermined number of subsequent layers atop said first and preceding layers to form a subunit;

disposing and fixing said subunits radially about an optical axis of said optic unit such that said polycapillary fibers have exit ends thereof focused on a common focal point.

17. An x-ray apparatus for use in obtaining polarimetry data on an object, comprising:

at least one detector for detecting x-rays;

an optic module disposed in front of each of said at least one detectors and having an optical axis aligned therewith, each of the optic modules having polycapillary fibers with entrance ends open to an entrance aperture of the x-ray apparatus and exit ends aligned to direct x-rays entering the entrance ends to said respective one of said detectors, said polycapillary fibers being asymmetrically arranged about said optical axis; and means for rotating as a whole said at least one detector and said optic module with respect to said object to acquire polarimetry data from said detectors.

18. The apparatus according to claim 17 wherein said polycapillary fibers are bent along a path of a natural cubic spline and are of varying lengths as determined by tangential points on said polycapillary fibers whereat a straight line from said at least one detector tangentially intersects said natural cubic spline.

19. The apparatus according to claim 17 herein said optic module includes means for moving said polycapillary fibers at said entrance ends to positions which are collimated.

20. The apparatus according to claim 19 wherein said means for moving includes:

a mesh having apertures for receiving said polycapillary fibers, said mesh being slidably mounted in said optic module to slide along said optical axis between a retracted position, whereat said mesh is removed from said entrance ends of said polycapillary fibers to allow said polycapillary fibers to splay radially outward to decollimated positions, and a forward position proximate said entrance ends whereat said mesh is move into contact with outermost ones of said polycapillary fibers to displace said polycapillary fibers into collimated positions; and means for moving said mesh between said retract position and said forward position.

21. An x-ray telescope for imaging an object comprising:

a tubular housing subdivided into M number of radial segments, each of said radial segments having a detector for detecting x-ray disposed proximate a base end of said tubular housing and an optic module at an entrance aperture of said tubular housing for focussing x-rays entering said entrance end onto said detector;

each of said optic modules having polycapillary fibers with entrance ends open to said entrance aperture and exit ends aligned to direct x-rays entering the entrance ends to an associated one of said detectors, said polycapillary fibers being decollimated at said entrance ends to provide a predetermined field-of-view;

a Fourier grid assembly disposed in front of said optic modules and having M pairs of entrance and exit grids each aligned with a respective one of said optic modules, said pairs of entrance and exit grids having spaced apart bars with a bar spacing period such that N number of said bar spacing periods at said entrance grid subtends said predetermined field-of-view of said polycapillary fibers where N is an integer and is different for each of said pairs of entrance and exit grids; and each of said pairs of grids having said entrance grid and said exit grids phased apart by ⅛ of said bar spacing period for said pair of grids; and means for rotating as a whole said tubular housing and said Fourier grid assembly with respect to said object to acquire imaging data from said detectors.

22. The x-ray telescope according to claim 21 wherein said bar spacing periods are determined by N ranging from 1 to M.

23. The x-ray telescope according to claim 21 wherein:

said optic modules have said polycapillary fibers asymmetrically arranged, in accordance with filling said radial segments, with respect to an optical axis thereof to permit detection of polarimetry data; and said apparatus further includes means for rotating said Fourier grid assembly with respect to said optic modules to successively align respective ones of said entrance and exit grid pairs with respective ones of said optic modules to simultaneously acquire both polarimetry data and said imaging data from said detectors by independently modulating said imaging data and said polarimetry data to permit separation thereof.

24. The x-ray telescope according to claim 21 wherein said polycapillary fibers are bent along a path of a natural cubic spline and are of varying lengths as determined by tangential points on said polycapillary fibers whereat a straight line from said at least one detector tangentially intersects said natural cubic spline.

25. The x-ray telescope according to claim 21 further comprising:

calculating means for applying Hartley transform techniques to said imaging data to produce an image of said object; and means for transmitting said imaging data to said calculating means.

26. The x-ray telescope according to claim 21 wherein said at least one optic module includes means for moving said polycapillary fibers at said entrance ends to positions which are collimated.

27. The x-ray telescope according to claim 26 wherein said means for moving includes:

a mesh having apertures for receiving said polycapillary fibers, said mesh being slidably mounted in said optic module to slide along said optical axis between a retracted position, whereat said mesh is removed from said entrance ends of said polycapillary fibers to allow said polycapillary fibers to splay radially outward to decollimated positions, and a forward position proximate said entrance ends whereat said mesh is moved into contact with outermost ones of said polycapillary fibers to displace said polycapillary fibers into collimated positions; and means for moving said mesh between said retracted position and said forward position.

* * * * *